United States Patent [19]

Collmeyer et al.

[11] Patent Number: 4,496,944

[45] Date of Patent: Jan. 29, 1985

[54] GRAPHICS DISPLAY SYSTEM AND METHOD INCLUDING ASSOCIATIVE ADDRESSING

[75] Inventors: Arthur J. Collmeyer, Saratoga; Jeffrey H. Hoel, Sunnyvale; Paul F. King, LaJolla; Donald O. Stanley, San Jose; Roger Sturgeon, Santa Cruz, all of Calif.

[73] Assignee: Calma Company, Sunnyvale, Calif.

[21] Appl. No.: 417,637

[22] Filed: Sep. 13, 1982

Related U.S. Application Data

[62] Division of Ser. No. 125,843, Feb. 29, 1980, abandoned.

[51] Int. Cl.[3] ..... G09G 1/00

[52] U.S. Cl. ..... 340/723; 340/727; 340/750; 340/747; 365/49

[58] Field of Search ..... 340/723, 727, 747, 721, 340/745, 750; 365/49, 50, 230

[56] References Cited

U.S. PATENT DOCUMENTS

| | | | |
|---|---|---|---|
| 3,473,160 | 10/1969 | Wahlstrom | 340/750 |
| 4,280,186 | 7/1981 | Hidai et al. | 340/747 |
| 4,290,064 | 9/1981 | Traster | 340/723 |
| 4,368,462 | 1/1983 | Crawley | 340/723 |
| 4,371,872 | 2/1983 | Rossman | 340/723 |

*Primary Examiner*—Marshall M. Curtis

*Attorney, Agent, or Firm*—Flehr, Hohbach, Test, Albritton & Herbert

[57] ABSTRACT

A graphics display system is disclosed including a memory circuit for storing vector data representing a graphics image, a raster memory circuit for rasterizing the vector data into a second memory for storage, and a processor for controlling the operation of the vector memory and raster memory circuits. The raster data can be displayed on a suitable cathode ray tube monitor, thereby displaying the graphics image on the monitor.

19 Claims, 47 Drawing Figures

SET VIEW PARAMETERS: (04)

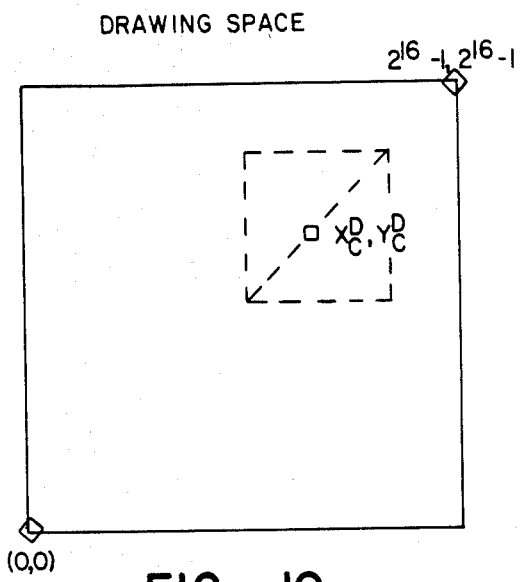
FIG.—10
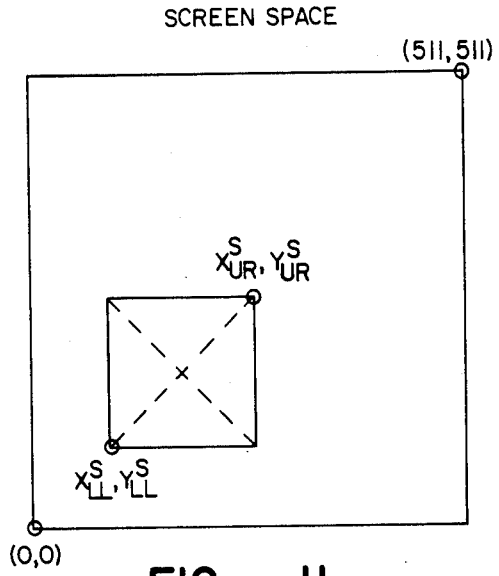
FIG. — 11
SET CURSOR: (05)
FORMAT:
CDW
CPT
| WORD | CONTENTS | | | |
|---|---|---|---|---|
| 0 | 05 | | | VP |
| 1 | D | C | S | |
| 2 | X | | | |
| 3 | Y | | | |
FIG.—12
| WORD | CONTENTS |
|---|---|
| 0<br>1<br>•<br>•<br>•<br>5 | $MASK_0$<br>(6 words to be ANDed with words 2 to 7 or entity headers) |
| 6<br>•<br>•<br>• | $MASK_1$<br>(6 words to be compared with $MASK_0$ AND entity headers) |
FIG. — 13

MODIFY IF EQUAL/NOT EQUAL: (12/13)

| FORMAT: | WORDS | CONTENTS | | | |
|---|---|---|---|---|---|
| CDW | 0 | 12/13 | D | M | ////// |
| CPT | 1-6 | $MASK_0$ | | | |
| | 7-12 | $MASK_1$ | | | |
| | 13-18 | $MASK_2$ | | | |
| | 19-24 | $MASK_3$ | | | |

FIG. —14

DELETE IF EQUAL/NOT EQUAL: (10/11)

| FORMAT: | WORDS | CONTENTS | | | |
|---|---|---|---|---|---|
| CDW | 0 | 10/11 | D | M | ////// |
| CPT | 1-6 | $MASK_0$ | | | |
| | 7-12 | MASK | | | |

FIG. — 15

TRANSLATE IF EQUAL/NOT EQUAL: (14/15)

| FORMAT: | WORDS | CONTENTS | | | |
|---|---|---|---|---|---|
| CDW | 0 | 14/15 | D | M | ////// |
| CPT | 1-6 | $MASK_0$ | | | |
| | 7-12 | $MASK_1$ | | | |
| | 13-18 | $MASK_2$ | | | |
| | 19-24 | $MASK_3$ | | | |

FIG. —16

SET VIEW PARAMETERS IF EQUAL/NOT EQUAL: (16/17)

| FORMAT | WORD | CONTENTS | | | | |
|---|---|---|---|---|---|---|
| CDW | 0 | 16/17 | D | M | N | |
| CPT | 1-6 | $MASK_0$ | | | | |
| | 7-12 | $MASK_1$ | | | | |
| | 13 | PARAMETER FLAGS | | | | |
| | 14 | $X_C^D$ | | | | P0 |
| | 15 | $Y_C^D$ | | | | P0 |
| | 16 | SCALE (BITS 0-15) | | | | P1 |
| | 17 | SCALE (BITS 16-31) | | | | P1 |
| | 18 | $X_{LC}^S$ | | | | P2 |
| | 19 | $Y_{LC}^S$ | | | | P2 |
| | 20 | $X_{UR}^S$ | | | | P3 |
| | 21 | $Y_{UR}^S$ | | | | P3 |
| | 22 | CENSORING VALVE | | | | P4 |

FIG. —17

IDENTIFY POINT IF EQUAL / NOT EQUAL: (20/21)

| FORMAT: | WORD | CONTENTS | | | |
|---|---|---|---|---|---|
| CDW | 0 | 20/21 | D | M | |
| CPT | 1-6 | $MASK_0$ | | | |
| | 7-12 | $MASK_1$ | | | |
| | 13 | $X^D_{LL}$ | | | |
| | 14 | $Y^D_{LL}$ | | | |
| | 15 | $X^D_{UR}$ | | | |
| | 16 | $Y^D_{UR}$ | | | |
| | 17 | XI | | | |
| | 18 | YI | | | |
| | 19 | ALL 1's | | | |

FIG.—18

IDENTIFY WINDOW IF EQUAL / NOT EQUAL: (24/25, 26/27)

| FORMAT: | WORD | CONTENTS | | | |
|---|---|---|---|---|---|
| CDW | 0 | 24/25-26/27 | D | M | |
| CPT | 1-6 | $MASK_0$ | | | |
| | 7-12 | $MASK_1$ | | | |
| | 13 | $X^D_{LL}$ | | | |
| | 14 | $Y^D_{LL}$ | | | |
| | 15 | $X^D_{UR}$ | | | |
| | 16 | $Y^D_{UR}$ | | | |

FIG.—19

| 15 — 10 | 09 — 08 | 07 — 04 | 03 — 00 |
|---|---|---|---|
| CC | OD | MD | SF |

FIG.—20

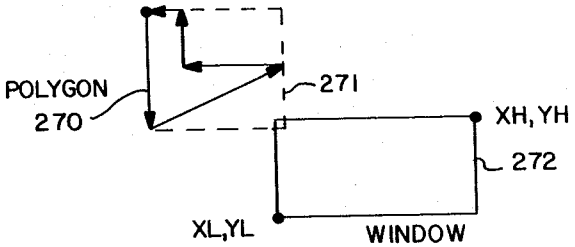
FIG.—27A
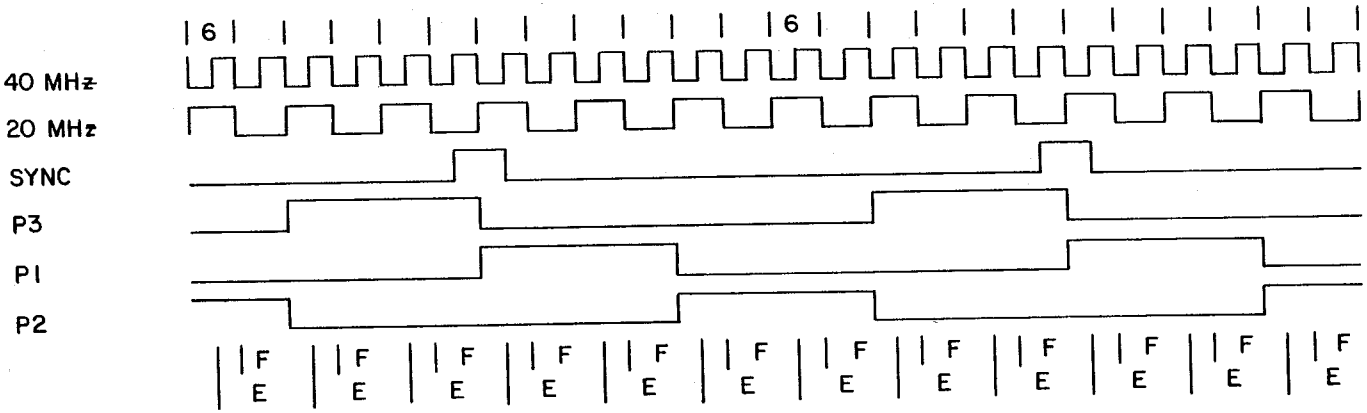
FIG.—28
| | | | | | | | | | | | | | | | |
|---|---|---|---|---|---|---|---|---|---|---|---|---|---|---|---|
| GET INPUT | ACCX X+X+I | * \|X-XP\| | * \|ΔXP\|-CN | X-XL | XH-X CONDIT. XP+X | GET INPUT | * \|X-XP\| | * \|XP\|-CN | X-XL | XH-X CONDIT XP+X | GET INPUT | | | | |
| | GET INPUT | ACCX Y+Y+I | * \|Y-YP\| | * \|ΔYP\|-CN | Y-XL CONDIT. YP+Y | YH-Y | ACCY Y+Y+I | * \|Y-YP\| | * \|ΔYP\|-CN | Y-YL CONDIT YP+Y | YH-Y | | | | | |
| | | GET INPUT | ACCX | * \|X-XP\| | * \|ΔXP\|-CN | X-XL | XH-X | | GET INPUT | ACCY Y+Y+I | * \|Y-YP\| | * \|ΔXP\|-CN | Y-YL CONDIT. YP+Y+XP+X | GET INPUT | YH-Y | |
| | | | | | | | | | | | | | | | | |
SHORT FORM DATA
* SET VIEW ONLY
FIG — 29

FIG.—32
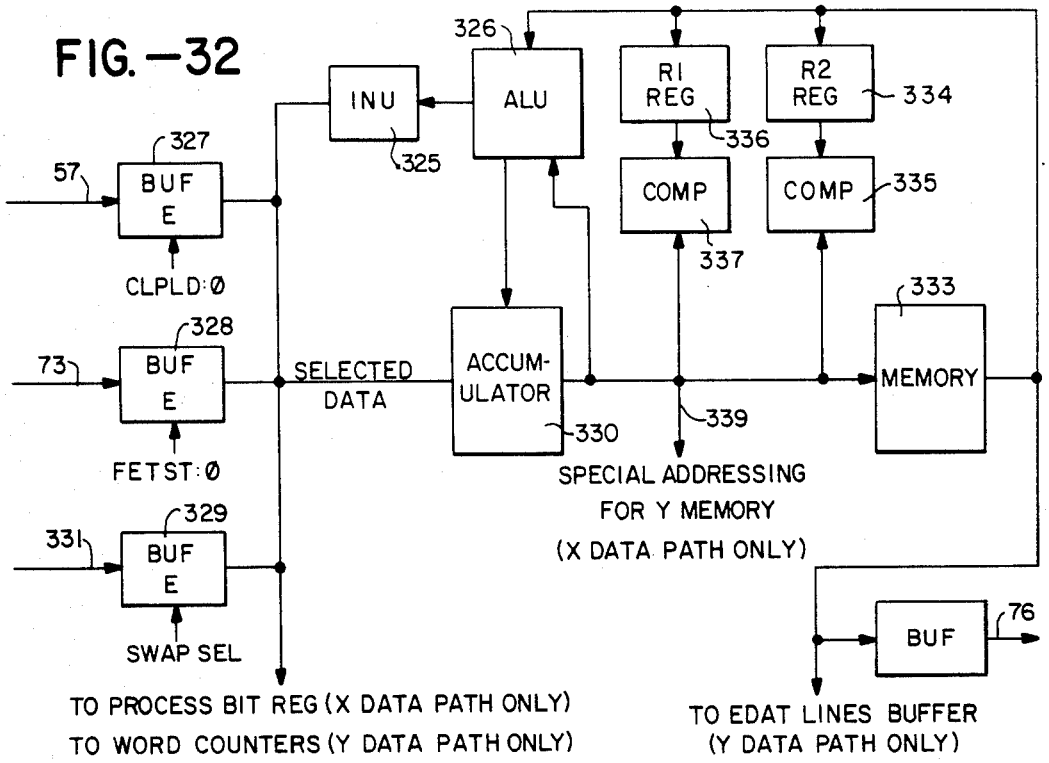
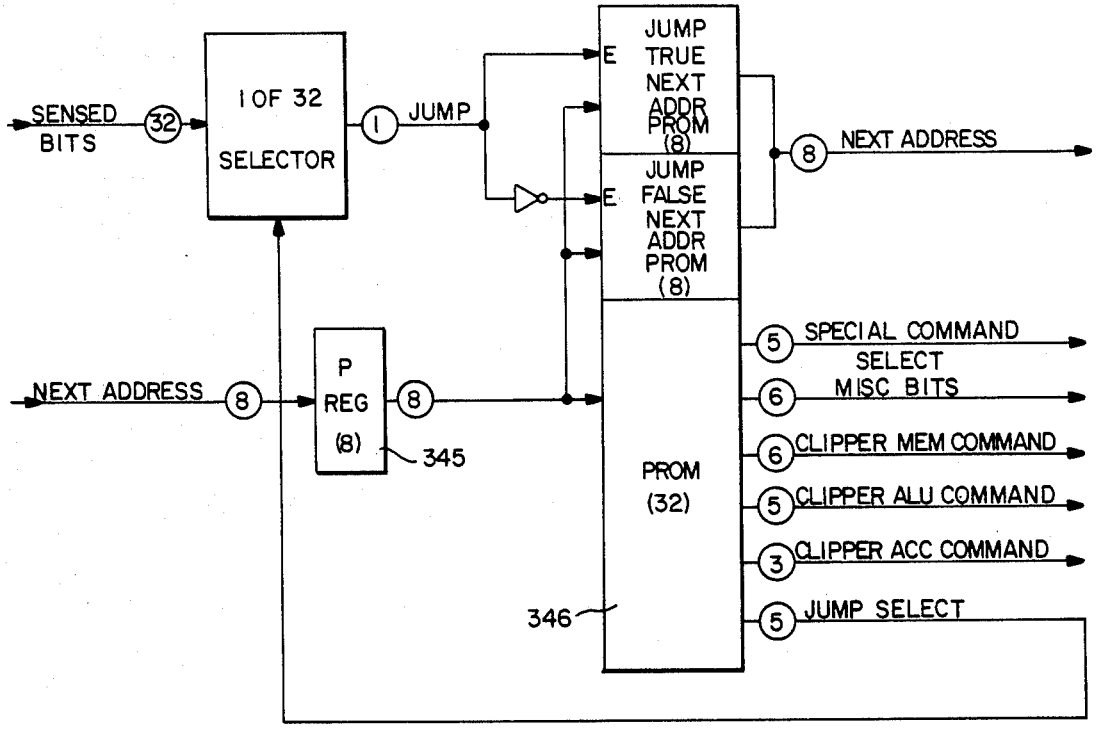
FIG.—33

X = DON'T CARE

GRAPHICS DISPLAY SYSTEM AND METHOD INCLUDING ASSOCIATIVE ADDRESSING

This is a division of application Ser. No. 125,843 filed Feb. 29, 1980, now abandoned.

BACKGROUND OF THE INVENTION

The present invention relates to a graphics display system and method.

Some prior art systems utilizing graphics displays have used a direct view storage tube display, which stores a graphic image directly on the face of a cathode ray tube, so that the image does not have to be continuously refreshed. This approach results in a high-resolution, flicker-free image. In addition to the stored image, a graphics cursor is continuously displayed in a write-through mode, so that it does not become a part of the stored image. By using a graphics tablet or digitizer as an input device, a user can point the cursor at objects on a screen and issue editing commands to the system to alter these objects or add new ones. This type of display has proved adequate for the vast majority of applications in such areas as integrated circuit and printed circuit design, cartography and three-dimensional drafting designing and manufacturing.

A problem with direct view storage tube displays is that an image cannot be selectively erased, since to alter a graphics image requires the erasing of the entire old image and redrawing an entire new one.

To overcome this problem, some prior art systems have employed calligraphic, or vector-stroking, displays continuously refreshed from a list of graphic vectors stored in a vector memory. In such a vector-stroking display, the display reads X-Y coordinate data and intensity information from the memory and strokes the indicated line segments onto the screen in connect-the-dot fashion. When vector data representing a graphic image is altered in the memory from which the display is refreshed, its image on the screen rapidly disappears and the altered portion of the image simultaneously appears, while the remainder of the image remains unchanged.

A problem with such a vector-stroking display is that the complexity of the image which can be displayed without perceptible flickering is fundamentally limited by how far the display tube's electron beam has to travel, how rapidly the beam can be deflected and modulated, and how rapidly the image disappears from the screen.

A display which refreshes the image from a raster memory (also known as dot matrix) avoids such problems of vector stroking. Flicker-free images can easily be generated regardless of the complexity because the electron beam always travels the same path, namely a top to bottom sequence of closely spaced left to right lines, as in a commercial television set. The raster memory is used only to modulate the intensity of the beam.

A problem with raster memories is that once data has been rasterized, there is no good way to deal with the resulting dots in the raster memory. If it is desired to remove only the dots corresponding to a given vector, one could rasterize the vector again and use the resulting sets of dots to erase the raster memory selectively, which would generally remove too many dots. It is desirable to remove only those dots which a particular vector was solely responsible for inserting, and to leave alone those dots which were also inserted by intersecting vectors, which is difficult if not impossible, since in a raster memory all dots look alike.

As a result, after a particular vector is removed, all conceivable intersecting vectors are rewritten into the memory. In a worst case this amounts to re-rasterizing of the entire vector image, which runs the risk of nullifying the reason for going to a refreshed display in the first place, namely the ability to alter the image rapidly. In view of the above background, there is a need for an improved graphics display system and method which provides both vector memory and raster memory capabilities without the above-mentioned limitations.

SUMMARY OF THE INVENTION

The present invention relates to a graphics display system and method.

The system and method includes vector memory means for managing or processing vector data representing a graphics image to be displayed, transformation means for transforming the vector data, raster memory means for rasterizing and displaying the data, and processor means for controlling the operation of the system.

The vector memory means include means for storing the vector data, memory update means (MUDS) for performing appropriate insert, modify, delete, and selection operations on the data, and preclipper means for performing geometric selection operations on the data.

The vector data from the vector memory means is transformed by the transformation means, which include a clipper means and a scaler means. The clipper means determines which vectors and parts of vectors are to be displayed and is further used to perform the computations involved in identify functions. The scaler means translates and scales the clipped vector data.

The raster memory means includes means for storing raster data, write means for rasterizing the vector data provided by the transformation means, and read means for displaying the raster data on a suitable cathode ray tube monitor.

In accordance with the above summary, the present invention achieves the objective of providing an improved graphics display system incorporating the advantages of both vector and raster memories.

Other objects and features of the present invention will become apparent from the following description when taken in conjunction with the drawings.

DESCRIPTION OF THE DRAWINGS

FIGS. 10 and 11 depict representation of a drawing space and a screen space, respectively, which are utilized by the system.

FIGS. 12–20 depict further formats of command functions utilized by the system.

FIG. 27A depicts a circumscribed polygon outside of a window.

FIG. 28 depicts a timing diagram for the preclipper circuit of FIG. 27.

FIG. 29 depicts a timing diagram for the preclipper circuit of FIG. 27.

FIG. 32 depicts a portion of a data path for the clipper circuit of FIG. 30.

FIG. 33 depicts a block diagram of a clipper processor, which forms a portion of FIG. 30.

DETAILED DESCRIPTION OF THE INVENTION

In order to understand the basic operation of the present invention, a system overview will be given in conjunction with the block diagram of a graphics display system depicted in FIGS. 1 and 2.

Figure 1:
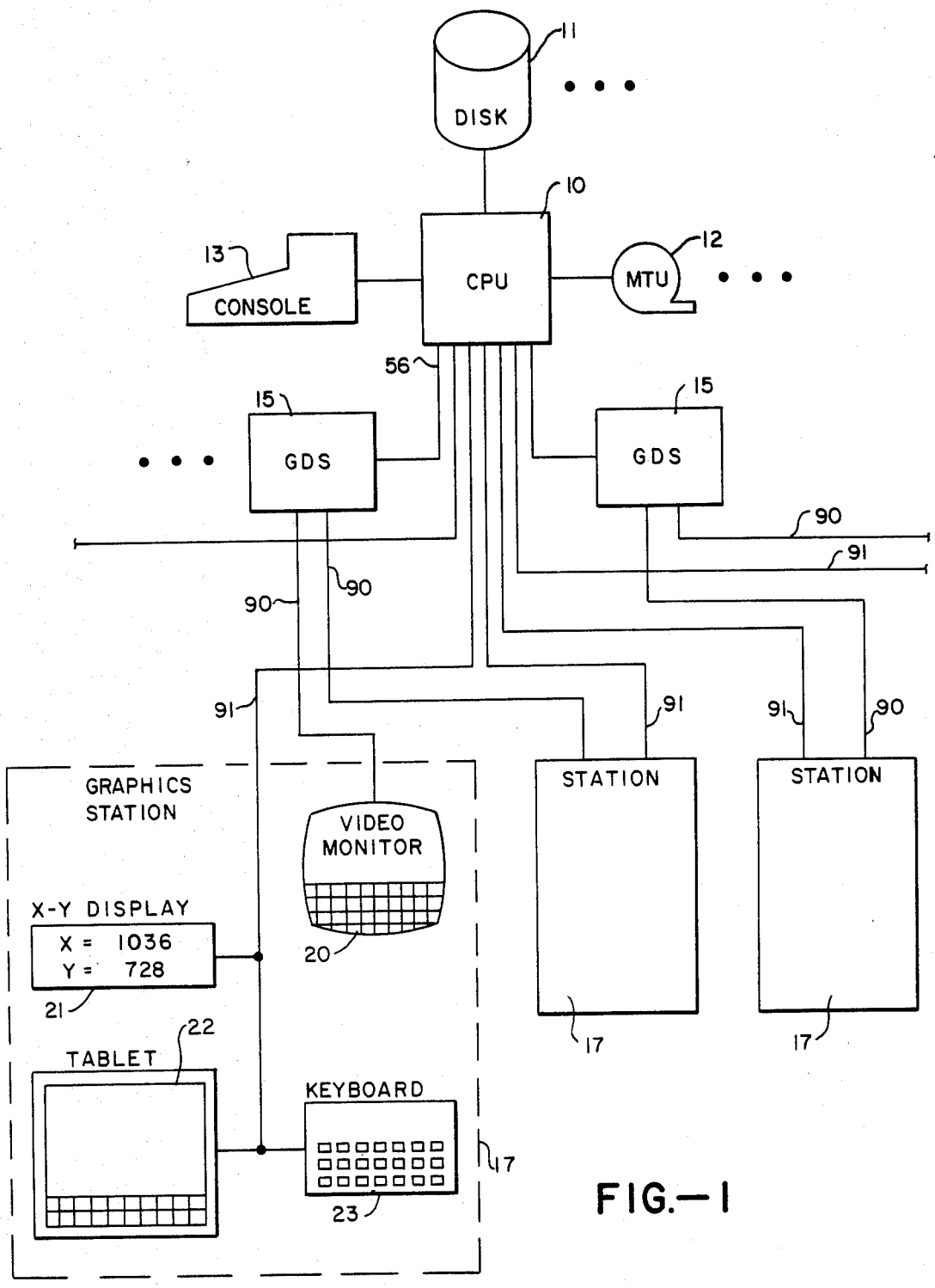
FIG. 1 depicts a block diagram of a graphics data system.

Referring to FIG. 1, a block diagram of a graphic data system is depicted for use in interactive graphics display systems needed in such areas as integrated circuit and printed circuit design, cartography, and three-dimensional drafting, designing and manufacturing.

In FIG. 1, a central processing unit (CPU) 10 controls the operation of the system and is connected to receive input information from console 13, disc unit 11, and magnetic tape unit (MTU) 12 by well known techniques.

CPU 10 is also connected to one or more graphics display systems (GDS) 15 via bus 56 and to one or more graphics station 17 via bus 91. GDS 15 is connected to one or more graphic stations 17 via bus 90 and provides display data on bus 90 for video monitor 20 under control of CPU 10. The subject matter of the present invention is directed toward the GDS 15, which is shown in more detail in FIG. 2.

In FIG. 1, graphics station 17 also includes X-Y display circuit 21 for displaying particular X-Y coordinates. Keyboard 23 and tablet 22, which are units known in the art, are connected to CPU 10 via bus 91, and provide means for communicating with CPU 10.

The system treats all data as polygons. If the beginning point and ending point of a polygon are identical, the polygon is considered closed; otherwise, it is open. The system gives the user, as will be described, the ability to define and manipulate both types.

Tablet 22 produces a pair of digital X-Y coordinate values corresponding continuously to the position of a writing stylus upon the surface of the tablet. The tablet can be placed on a table in front of the display screen, providing a natural writing position for the user.

Figure 2:
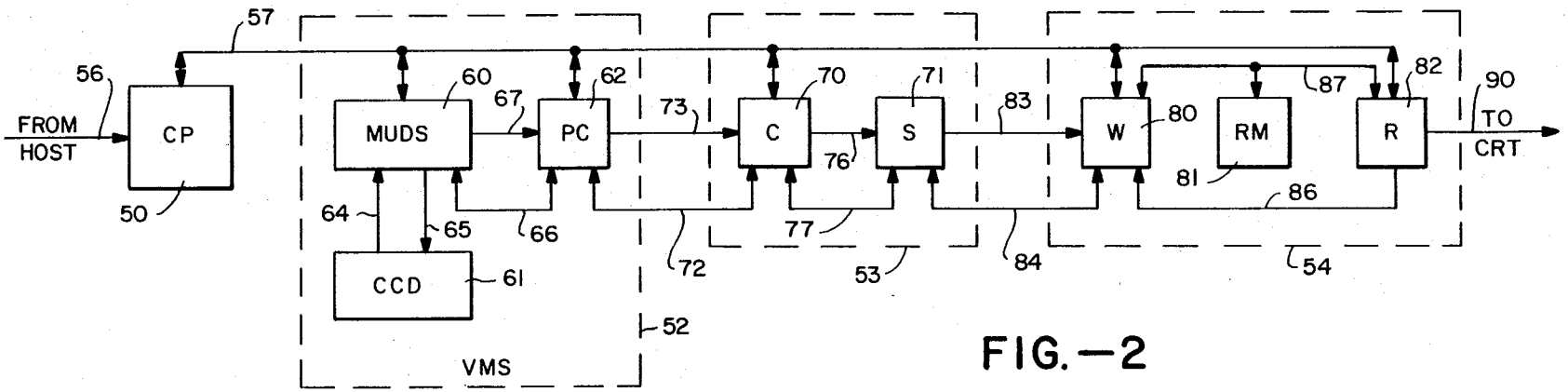
FIG. 2 depicts a block diagram of a graphics display system, which forms a portion of FIG. 1.

In FIG. 2, a command processor (CP) 50 serves as a command center during data transfers between the host processor (CPU 10) of FIG. 1 via bus 56 and the remainder of the system, processes data blocks before they are transferred to the remainder of the system, and generates appropriate timing and handshake signals on system bus 57.

The system also includes a vector memory subsystem (VMS) 52, which includes a vector memory 61, memory update system (MUDS) 60, and preclipper (PC) 62. The vector memory 61 could be a random access memory (RAM), magnetic bubble memory (MBM), or charge coupled device (CCD).

The MUDS 60 inserts vector data via bus 57 from the CP 50 into the vector memory 61 via bus 65, associatively searches and modifies items in memory 61 specified by CP 50, and selectively passes data from memory 61 via bus 64 to the PC 62 for the set view and identify functions, as to be described.

Memory 61 can be viewed as a 16×64K bit shift register operating at a 300 ns rate. 16-bit words are input to memory 61 on bus 65 and output on bus 64. Data output from memory 61 are processed through ring buffers in the MUDS 60 before they are re-input to memory 61.

Data from the VMS 52 are in vector data format and are sent via PC 62 to the transformation subsystem 53, which includes a clipper (C) 70 and scaler (S) 71 circuits. PC 62 accumulates data via bus 67 from MUDS 60 in relative coordinates and processes them to make the data absolute, compares line segment deltas with the censoring value received for the current set view to determine whether the current point needs to be retained for the clipper 70. PC 62 also performs a preliminary check on each polygon to determine whether it might intersect the window and sends to the transformation subsystem 53 only those polygons which pass this test.

The clipper 70 receives data from PC 62, performs clip functions, and delivers the processed data to the scaler circuit 71. Other system functions include, as will be described, identify point, identify segment, identify window partial and identify window full. The clipper 70 also delivers data upon command to the CP 50 via system bus 57. The scaler 71 circuit provides during a set view operation the magnify, translate, scale and buffer functions.

The processed data from the transformation system 53 is sent to the raster memory subsystem (RMS) 54, which includes write (W) circuit 80, refresh memory (RM) circuit 81 and read (R) circuit 82.

Write circuit 80 performs the function of rapidly generating points in a 512×512 matrix field to approximate the location of two-dimensional straight line vectors, which are subsequently transferred to 256K-bit refresh memory 81, which is used to refresh a standard raster-scan CRT monitor via bus 90 under control of read circuit 82. Refresh memory 81 receives the appropriate data from write circuit 80, and read circuit 82 generates the intensity and synchronization signals necessary to display a graphics image on a typical CRT monitor such as CRT 20 in FIG. 1 via bus 90. Other functions of the read circuit 82 are to erase refresh memory 81, display the cursors, and display the grid.

In the present embodiment, the data representing a graphical image is characterized in the form of polygons, as previously described.

Display Entities

Vector data representing one or more graphics images to be displayed, for example, on a conventional cathode ray tube (CRT) are stored in a vector memory subsystem 52, as depicted in FIG. 2.

A graphics image to be displayed is represented by a series of vectors, which form a pattern or figure representing an image to be displayed by a series of straight lines or vectors interconnected via their respective vertices. The vector data can be in the form of open or closed figures, and for convenience purposes will be described in terms of polygons.

Figure 3:
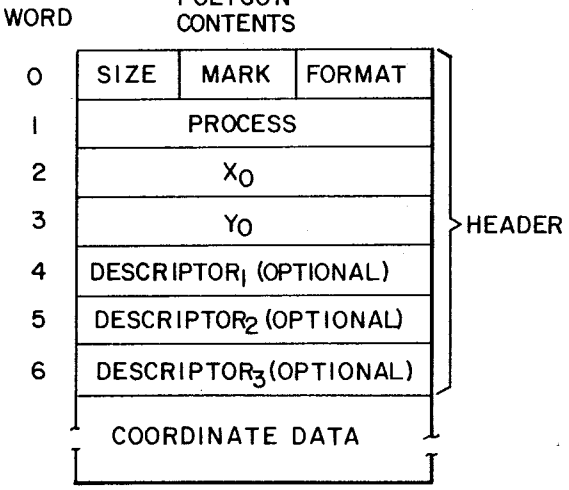

In FIG. 3, the word format of a polygon is depicted and includes, in one embodiment, between four and 126 16-bit words. Words 0–6 represent header information which describe and identify a particular polygon to the system.

Figure 4:
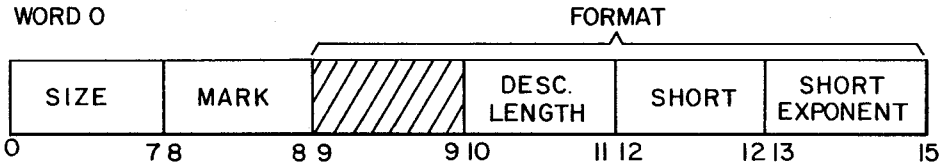
FIGS. 3–6 depict the word format of a polygon entity which is one form of data utilized by the system.

Word 0 of FIG. 3 is depicted in FIG. 4, and includes three pieces of information used by the system to recognize the boundaries and sub-boundaries of polygon entities, and to initiate/terminate selected operations on the entities.

In FIG. 4, bits 0–7 indicate the size N, where N is the total number of words in the entity. One entity in general describes one polygon. The mark bit (bit 8) is set to indicate the beginning of an operation on the entities, as will be described within the command section. The mark bit is reset on completion of such an operation. In the format section of word 0 (bits 9–15), the descriptor length is a 2-bit field indicating the number of descriptor words in the header portion of FIG. 3. Bit 12 is a short bit which is set to indicate that coordinate data are given as 8-bit integers (short form), rather than 16-bit integers (long form). Bits 13–15 are short form exponent bits describing the exponent applied in the event of short form coordinate data.

Figure 5:
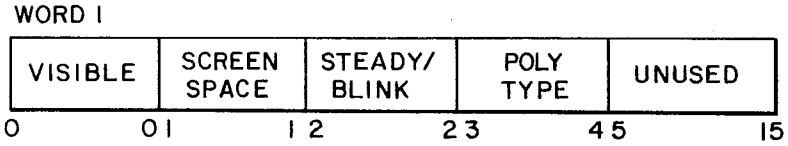

Word 1 of FIG. 3 is depicted in FIG. 5 and is a process word which describes the manner in which the entity is to be presented or displayed. The process word is a 16-bit field, formatted specifically for a given display mechanism.

For a vector memory used to refresh the refresh memory of a black and white raster monitor, a process word might include the visible/invisible bit, drawing space/screen space bit, and polygon type (2 bits).

For a color raster monitor, the process word could include visible/invisible bit, drawing space/screen space bit, polygon type (2 bits), and polygon color bits (3 bits).

The $X_0$ and $Y_0$ bits in words 2 and 3, respectively, of the header of FIG. 3, describe the first coordinate point in a polygon and each coordinate is represented by a 16-bit entry.

In FIG. 3, descriptor words 4–6 are a field of zero to three words in length incorporating the attributes of the corresponding system entity. An example of a descriptor might include layer number (5 bits), line type/font (8 bits), ID1 (3 bits), ID2 (16 bits) and ID3 (16 bits). Bits in the process field that are not interpreted directly by the display hardware are available for use as additional descriptor bits and hence in the case of black and white raster monitor, the process word might be allocated to include a visible/invisible bit, drawing space/screen space bit, steady/blink bit, polygon type (2 bits), layer number (5 bits), line type (3 bits), and ID1 (3 bits).

In FIG. 3, the coordinate data includes zero or more coordinate pairs—$(X_1, Y_1), \ldots (X_N, Y_N)$—defining successive vertices of a polygon. X and Y are relative coordinates and each is represented by a 16-bit entry (long form) or an 8-bit entry (short form). In the short form, the 8 bits represent the mantissa while the exponent is given by the short exponent bits, in word zero.

Figure 6:
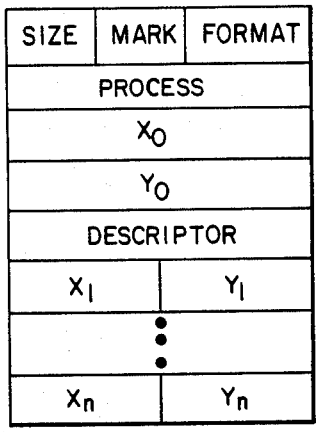

For illustration purposes as depicted in FIG. 6, if a one word descriptor in the header is adequate, and the drawing to be displayed comprises polygons only, and assuming the average number of vectors per polygon is five, and 90% of the vectors can be described in a short form, then the average number of words/polygon is about 10.5. Approximately 64K words equal 6K polygons or approximately 30K vectors. Schematics typically contain from 10,000–40,000 vectors, the majority of which could be described in the short form. Printed circuit boards typically contain between 20,000 and 80,000 vectors, the majority of which could be described as short form. IC's typically contain from 40,000 to 320,000 vectors, the majority of which could be described in short form.

A 2M-bit memory, with a capacity of 60K vectors, could accommodate most schematics and many printed circuits (PC's) in their entirety. In PC's, as in schematics, a character generator can achieve significant data compression and renders a 2M bit vector memory sufficient for these applications.

A 2M-bit vector memory, with a capacity of 60K vectors, could accommodate a quadrant or a complex layer of many integrated circuits (IC's). A 4M-bit memory is adequate in many IC design applications.

Commands

Figure 7:
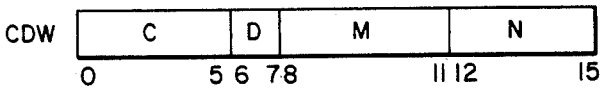
FIGS. 7–9 depict various command formats utilized by the system.

The system is controlled by the command processor 50 of FIG. 2 and the commands listed in Tables I and II are received from the host processor 10 of FIG. 1 and take the form of a 16-bit command designator word (CDW) followed by a (possibly empty) command parameter table (CPT). The CDW is depicted in FIG. 7 where the C-bits (bits 0–5) form the particular command codes according to Tables I and II. The D-bits (bits 6–7) are the minimum descriptor length for associative addressing functions (to be described). The M-bits (bits 8–11) of FIG. 7 form the memory bank selection mask which will be described in conjunction with the MUDS subsystem. The N bits (bits 12–15) represent the number of the affected viewport, which in one embodiment are numbered from 1 to 6.

The present invention incorporates two basic types of commands—general commands and associative addressing commands. The general commands are illustrated in Table I and the associative addressing commands are illustrated in Table II.

Commands are transmitted to the system by means of a data channel operation. Commands are batched together by placing them in contiguous memory locations and placing the sum of their lengths in a word counter. Each transmission consists of an integral number of commands.

Following the completion of a batched set of commands, command processor 50 signals host processor 10 via a data channel interrupt, requesting to transmit status information and the data, if any, generated by system 15 in response to the batched set of commands. When host 10 directs a read operation to system 15, command processor 50 transmits to host 10 a command buffer completion status word, followed by data words, if any.

The command buffer completion status word has the following format of bits 0–7 being an error code bits 8–15 being an error index. If system 15 was able to complete all commands in the batched set successfully, the error code is zero; otherwise the error code indicates what kind of error occurred and the error index indicates which command or data item within a command caused the error.

TABLE I

| GENERAL COMMANDS |
|---|
| INSERT |
| SET VIEW PARAMETERS |
| SET CURSOR |
| SET GRID |
| READBACK INSERT BUFFER |
| READBACK RASTER MEMORY |
| LOAD AND EXECUTE |

TABLE II

| ASSOCIATIVE ADDRESSING COMMANDS |
|---|
| DELETE IF EQUAL |
| DELETE IF NOT EQUAL |
| MODIFY IF EQUAL |
| MODIFY IF NOT EQUAL |
| TRANSLATE IF EQUAL |
| TRANSLATE IF NOT EQUAL |
| SET VIEW PARAMETERS IF EQUAL |
| SET VIEW PARAMETERS IF NOT EQUAL |
| IDENTIFY POINT IF EQUAL |
| IDENTIFY POINT IF NOT EQUAL |
| IDENTIFY VECTOR IF EQUAL |
| IDENTIFY VECTOR IF NOT EQUAL |
| IDENTIFY POLYGON TOUCHING OR IN WINDOW IF EQUAL |
| IDENTIFY POLYGON TOUCHING OR IN WINDOW IF NOT EQUAL |
| IDENTIFY POLYGON ENTIRELY INSIDE WINDOW IF EQUAL |
| IDENTIFY POLYGON ENTIRELY INSIDE WINDOW IF NOT EQUAL |

General Commands

Referring now to Table I, the insert command places the specified graphic entities set forth in the CPT within one or more of the selected memory modules of the vector memory subsystem. An error status indicator is set in the event the entities cannot be inserted due to lack of available space. The last entity to be inserted must have its mark bit (bit 8 of word zero) set to 1 and all the preceding entities have their mark bits set to 0.

Figure 8:
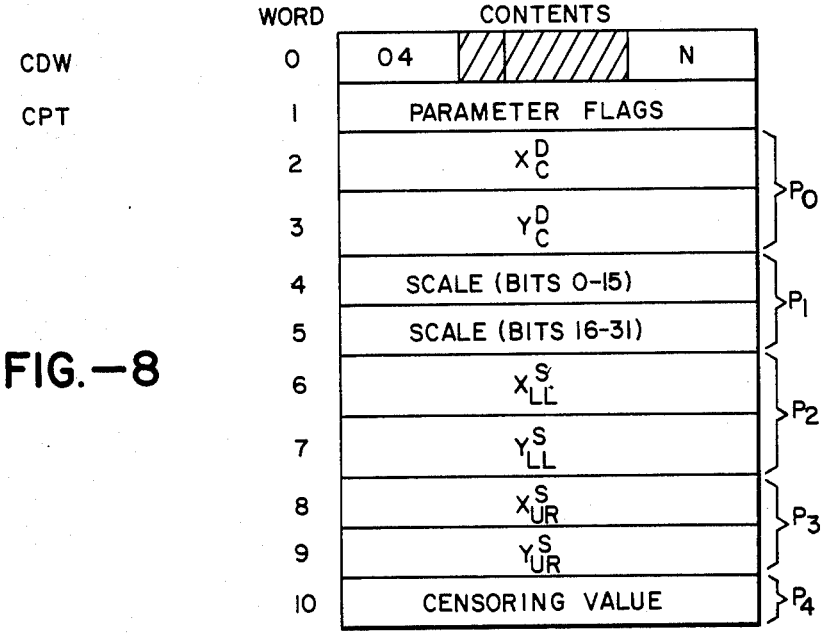

The set view parameters command is depicted in FIG. 8, which updates the parameters that control the data display in the system. Execution of this command also causes a full or partial redraw of data on the system's CRT screen. This command affects only the viewport specified by bits 12–15 in the CDW (word 0 in FIG. 8). Use of this command will in fact result in an associative set view command being issued to the system hardware by the command processor 50, as will be described in conjunction with associative commands. However, the associative addressing mechanism is used only trivially, to select all entities for viewing.

Figure 9:
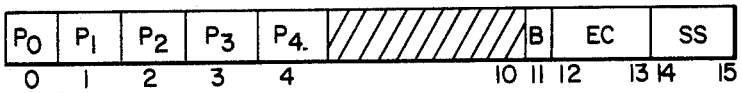

In FIG. 8, the first word of the CPT (word 1) contains parameter presence flags, erase control field, and an entity space selection mask in the format depicted in FIG. 9.

In FIG. 9, bits 0–4, when set to 1, indicate the presence in the CPT of a new value for the respective parameter. When set to 0, the respective parameter entries in the CPT are to be ignored and their previous values retained.

The background field B (bit 11) is used to specify the background for the currently defined viewport. When bit 11 is set to zero, the vectors are shown as white lines with a black background. If bit 11 is set to one, the vectors are shown as black lines with a white background.

The erase control field EC (bits 12–13) is used to signal a total (bit 12=1) or a partial (bit 13=1) erase of the screen (i.e., raster memory) that is to precede the generation of new display data. A partial erase affects only the current rectangular viewport as defined by $(X_{LL}^S, Y_{LL}^S)$, $(X_{UR}^S, Y_{UR}^S)$ and as depicted in FIG. 11. When the erase control field is zero, all erasing is inhibited and all display data generated are merged with the existing display.

The entity space selection mask SS (bits 14–15) is used to restrict the display of data to visible entities within the designated spaces. If bit 14=1, then the graphic representations for drawing space entities are generated. Similarly, if bit 15=1, then the graphic representations for screen space entities are generated. A zero setting of either bit will cause inhibiting of the display for the associated entity space.

In FIG. 8, following the parameter flags word, the next two words (words 2 and 3) of the CPT are $X_C^D$ and $Y_C^D$ which specify the coordinates of the center in drawing space of the rectangular viewport that appears on the screen, as illustrated in FIG. 10. The next two words (words 4–5) in FIG. 8 specify the scale factor to be applied in mapping drawing space to screen space as a 32-bit, standard format, normalized, floating-point value.

The next two words of the CPT (words 6 and 7) are $X_{LL}^S$ and $Y_{LL}^S$ which specify the coordinates, in screen space, of the lower left-hand vertex of the desired rectangular viewport which are followed by $X_{UR}^S$ and $Y_{UR}^S$ which are the coordinates of the upper right hand vertex of the viewport, all of which are depicted in FIG. 11.

Following the viewport specifications, the censoring value in word 10 determines the minimum axial distance that a polygon must transverse before a vector representing one or more polygon sides is inked. Each polygon is represented by at least a single vector from the first to the last vertex.

Referring to FIG. 12, the set cursor command controls the display of one of the system's cursors and includes a CDW and a three word CPT. The CDW contains a 3-bit VP field which designates the viewport in which the cursor is to appear. The first word of a CPT includes a single bit D flag which determines the current display status, where zero represents cursor off and one represents cursor on. If the D flag is set to zero, then the display of the cursor is inhibited and the coordinates are ignored. When the D flag is set to one, the cursor is displayed at the specified location in screen space. A 2-bit C-field designates which of the unit's cursors is to be affected. A single bit S-flag specifies in which space the coordinates are contained. When the S-flag is set to zero, the coordinates are given in terms of drawing space and the cursor is appropriately displayed within the designated viewport. When the S-flag is set to one, the coordinates are contained within screen space.

Referring now to FIG. 13, the associative addressing commands that associatively address the vector memory subsystem include two 6-word masks within the command parameter table (CPT). The two masks, MASK0 and MASK1, occupy the first 12 words of the CPT.

In FIG. 13, two masks are applied to an entity header to compute a Boolean value termed "selection condition". The resulting value then determines whether the command addresses (i.e., should operate on) a given entity. The selection condition value is determined by extending an entity's header as depicted in FIG. 3 to a full seven words by appending zeroes are required; ANDing the second through seventh word of the entity's headers with the six words of MASK0; testing for equality the six word result with MASK1 and setting the zero the selection condition if the values are equal, or to one if the values are unequal.

Two additional parameters, provided in the CDW of each associative addressing command, further affect the interpretation of the selection condition. The D field specifies the minimum number of optional descriptor words which must be present in the header of an entity as a prerequisite for being addressed. If an entity has fewer optional descriptors than the number specified in the D field of the command, then the command does not address the entity, regardless of the selection condition. The M field specifies which memory modules within vector memory subsystem 52 are to be affected by the command. If an entity is stored in a memory module which is specified in the M field not to be affected by the command, then the command does not address the entity.

MASK0 functions as a bit selection mask and MASK1 functions as a qualification value. That is, an entity's selection condition will be true (0) or false (1) depending on whether it equals or does not equal the qualification value in those bit positions specified in the bit selection mask. Each associative addressing function can operate on all entities whose selection condition is either zero or one. All commands that associatively address memory require a command parameter table. The format of each respective CPT is described below in conjunction with the associative addressing commands.

FIG. 14 depicts the modify if equal/not equal commands of Table II, which change the contents of the headers of those entities whose computed selection condition matches that specified in the given command. The second through seventh words of an entity headers will be replaced by the corresponding word of the quantity (HEADER AND MASK2) XOR MASK3. Only the existing header words are modified and thus the length of an entity's header remains unchanged.

FIG. 15 depicts a delete if equal/not equal command of Table II, which removes all entities from the vector memory whose computed selection condition matches that specified in the given command.

FIG. 16 depicts a translate if equal/not equal command of Table II, which changes the contents of the headers of those entities whose computed selection condition matches that specified in the given command. The second through seventh words of an entity header are replaced in the corresponding word of (HEADER AND MASK2) PLUS MASK3. Only existing header words are modified and thus the length of the entity's header remains unchanged.

FIG. 17 depicts a set view parameters if equal/not equal command of Table II, which causes those entities whose computed selection condition matches that specified in the given command to be displayed in accordance with the rest of the parameters in the CPT.

FIG. 18 depicts the identify point if equal/not equal commands of Table II, whose first function is to qualify those entities whose computed selection condition matches that specified in the given command. Those entities that qualify for identification are next checked to insure that at least one point falls within the drawing space viewport specified at the lower left and the upper right corner specified in words 13 through 16 of the CPT. For an entity meeting the above requirements, D is calculated such that D=maximum ($|X-XI|$ or $|Y-YI|$), where X and Y are contained within the polygon's coordinate list) is computed. On completion of testing of all qualifying entities, the header of the entity for which D assumes a minimum value is made available to the host CPU.

The identify segment if equal/not equal command has the same format as depicted in FIG. 18 except that X and Y are computed to the point on any line segment of the entity closest to (XI, YI) before D is computed.

FIG. 19 depicts the identify polygon touching or in window if equal/not equal command, whose first function is to qualify those entities whose computed selection condition matches that specified in the given command. Those entities that qualify for identification are next checked against the drawing space window specified in the command. The headers of the first several entities found touching or totally within the window are returned to the host computer. The identify polygon entirely within window if equal/not equal command has the same command format and functions similarly.

FIG. 20 depicts the contents of the system data bus 57 of FIG. 2 during the time that a command designator word (CDW) is being output by the command processor, in which the OD field (bits 8–9) is an optional descriptor field used by the MUDS system only when processing associative commands, and the MD field (bits 4–7) specifies which memory modules of VMS 52 are to be affected by the command. The SF field (bits 0–3) is a special flag field in which bit zero is set to one during a set cursor command to designate cursor on. Bits Ø, 1 and 2 are also used during any associative command to inform the memory update system of the selection condition for items missing optional descriptors. The appropriate bit set to one indicates a not equal condition. Bit Ø specifies the condition for one missing descriptor, bit 1 for two missing descriptors and bit 2 for three missing descriptors. The CC field (bits 10–15) will be described subsequently.

Command Processor

Figure 21:
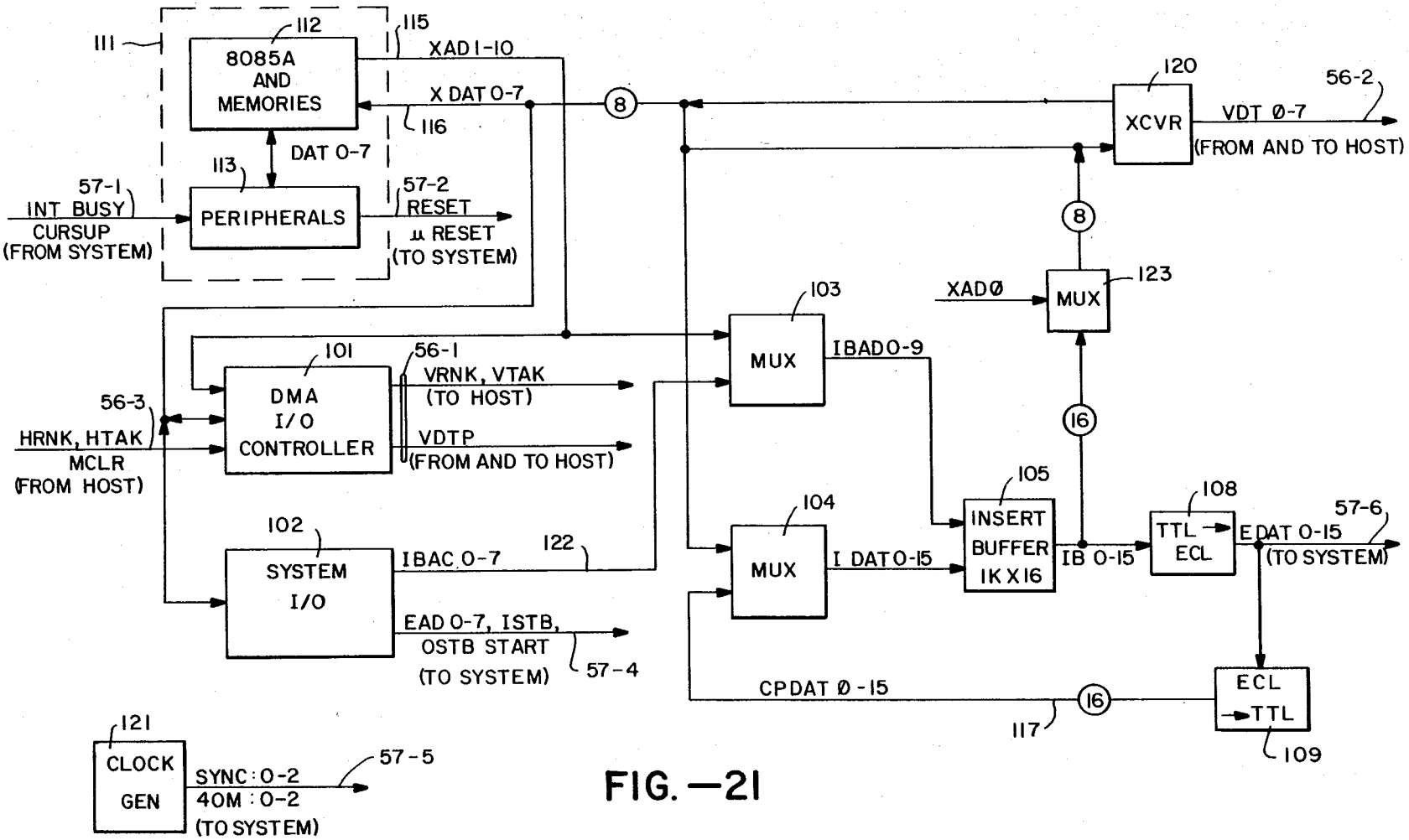
FIG. 21 depicts a block diagram of a command processor, which forms a portion of FIG. 2.

The command processor (CP) 50 of FIG. 2 is depicted in more detail in FIG. 21. The command processor (CP) 50 serves as a command center during transfers between the host CPU 10 of FIG. 1 via bus 57 of FIG. 2 and the remainder of the system, processing data blocks, generating the clocking signals and proper handshaking signals for data transfer sequences.

The command processor 50 includes a microprocessor circuit 111 which includes typically a microprocessor and memory subsection 112 having read only memory (ROM), random access memory (RAM), and general purpose peripherals 113. The system program is stored in a ROM of circuit 112.

Processor 111 may include, for example, an Intel 8085A microprocessor, together with associated peripherals, the details of which are known in the art.

In FIG. 21, the direct memory access (DMA) I/O controller 101 is connected to receive address signals on bus 115 and data signals on bus 116 from the microprocessor 111. Also, controller 101 receives control signals from the host CPU via bus 57-6 and 56-1.

Multiplexer (MUX) 103 receives address signals from processor 111 and system I/O controller 102. MUX 104 receives data signals from processor 111 and from the system via bus 58, ECL-TTL circuit 109, and bus 117.

Transceiver circuit (XCVR) 120 receives data signals from multiplexer 123, as well as data signals from the host CPU via bus 56-2. Clock generator 121 generates the appropriate SYNC and 40 MHz signals for the system on bus 57-5.

When the host CPU has a block of data to be transferred to the command processor, it activates the host request line (HRNK) to controller 101, which responds with an acknowledge signal (VTAK) when it is ready to accept data. The host CPU 10 inserts two 8-bit bytes, which constitutes a 16-bit word, into the insert buffer 105, a 1K×16-bit buffer. Processor 111 waits until it has a 256-word block available, which constitutes a maximum length transfer, before responding to the request. The program functions include setting a counter (not shown) in controller 101 to the word count minus one, sending to controller 101 a starting address in insert buffer 105 into which it can begin loading the data from host CPU. From that point, the transfer is effected solely by the host CPU and controller 101. Data is transferred in 2-byte (16-bits) burst mode until completion of transfer. CP 50 examines newly transferred data and determines how to process it.

Assuming that the first command in the data block is the insert command illustrated in Table I previously, the CP 50 programs system controller 102 to output the insert command and all of the header and associated coordinate data words with that command onto system bus 57-4. Appropriate programming operation includes sending to the system controller 102 the address of the insert buffer 105 location that contains the insert command, loading a controller counter (not shown) with the number of words associated with the insert command, and providing the controller 102 with an address to output onto the address bus 122. The IBAC signal on bus 122 is an address which points to the location in buffer 105 where a command is stored. The EAD signal on bus 57-4 is the system address which is distributed to the system.

The first word that I/O controller outputs onto the data bus 57-4 is the insert command. At that time, the controller 102 outputs the CP-provided address (of zero or 80, hexidecimal) onto address bus 122, which indicates that there is a CDW on the EDAT bus 57-6, which is meant for some circuits in the system. Another indication of the presence of a CDW is that it is the first word of a set of words presented on the bus at 300 ns intervals. Because the command is an insert command, the address placed on the address bus 122 is recognized only by the MUDS subsystem. Consequently, only the MUDS subsystem loads the command code into its command decoder and upon decoding the command, the MUDS replies that a number of words are about to be output onto the data bus 57-4, which must be inserted into the vector memory. These words define a number of items which jointly comprise part of a drawing that is to be displayed on the system's CRT. As the words are placed onto the data bus 57-4 via the I/O controller 102, they are taken by the MUDS and inserted into the vector memory. The six most significant bits of some of the data words may be configured exactly like a command code but such words will be interpreted as data rather than command because there will be no valid addresses on the address bus 122.

While the MUDS system is busy executing the insert command, the busy line on bus 57-1 is enabled or asserted (the busy line is enabled whenever any circuit is executing a command). When system controller 102 has outputted all the words it was programmed to output, it places a start signal on bus 57-4 and the MUDS interprets this signal as the end of the item transferred. When the MUDS has received the start signal from the I/O controller 102, and has finished processing the last word associated with an insert command, it frees the CP busy line on bus 57-1. When the CP recognizes the busy signal on 57-1 is free, it examines the next word in insert buffer 105 and starts processing the next command.

The DMA controller 101 transfers 16-bit data words from the host processor to the insert buffer 105, performs parity generation and checking overall transfers, is capable of addressing any location in insert buffer 105, and includes a word count register (not shown) capable of handling a 256-word transfer. The word count register is capable of being loaded and read back by the CPU.

The request signal, HRNK on bus 56-3, is activated during a download operation when data is being placed on the bus by host 10. It remains until DMA controller 101 activates system acknowledge, VTAK on bus 56-1, signaling host 10 that it is ready for the download. If DMA controller 101 detects a parity error in the transmission, it activates system negative acknowledge, VRNK on bus 56-1, rather than VTAK, which aborts the download. Error-free transmissions proceed with HRNK/VTAK handshake exchanges, one for each data byte transferred, until host 10 asserts host terminal count, HTAK on bus 56-3, which terminates the download.

When system 15 has data to upload to host 10, it begins by asserting system request, VRNK on bus 56-1. After host 10 returns a host acknowledge, HTAK on bus 56-3, system 15 begins the upload by placing data on the bus and reasserting VRNK. Error-free transmissions proceed with VRNK/HTAK handshake exchanges, one for each data byte transferred, until system 15 asserts system terminal count, VTAK on bus 56-1, which terminates the upload. If host 10 detects a parity error in the data received it asserts host negative acknowledge, NRNK on bus 56-3, rather than HTAK, which aborts the upload.

The system controller 102 transfers 16-bit data words between the buffer 105 and the system data bus EDAT 57-6. Controller 102 includes an address register IBAC capable of addressing any location in the buffer 105. The contents of another 8-bit counter/register within controller 102 are placed on the system address bus EAD 57-4 during certain I/O operations as commanded by the CPU. A word count register capable of handling a 256-word transfer is included. Controller 102 is programmable by the CPU to output to the system an output strobe (OSTB) signal on bus 57-4 and data and addresses on the system busses EDAT and EAD, respectively. When programmed to input data from the system data bus, the controller 102 sends an input strobe (ISTB) to the system. Sometime after ISTB has been received, the input data should be placed on the system data bus to be latched and written into insert buffer 105.

Figure 21A:
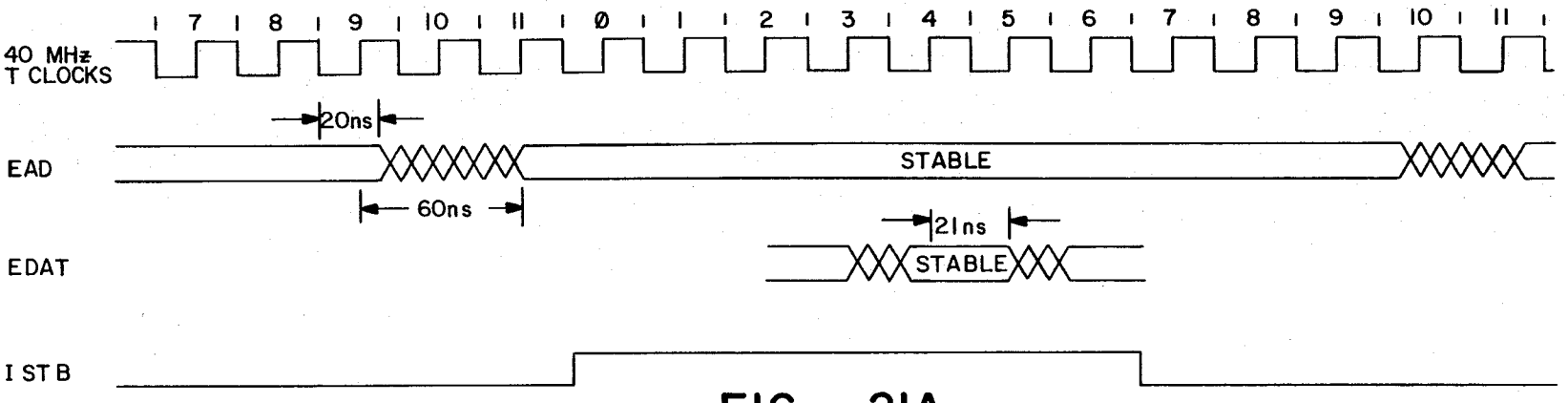
FIGS. 21A and 21B depict system timing diagrams.
Figure 21B:
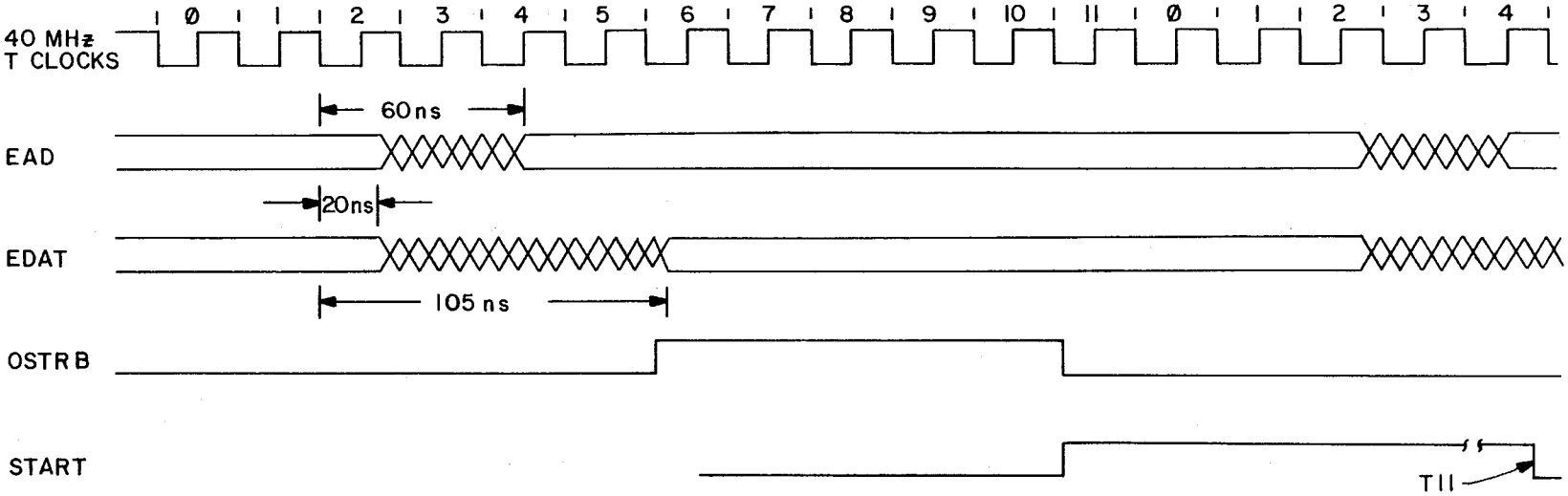

The clock generator 121 supplies the SYNC and 40 MHz signals to the system as depicted in FIGS. 21A and 21B.

FIG. 21A depicts timing signals from the system to CP 50, and FIG. 21B depicts timing signals from CP 50 to the system.

Memory Update System

Figure 22A:
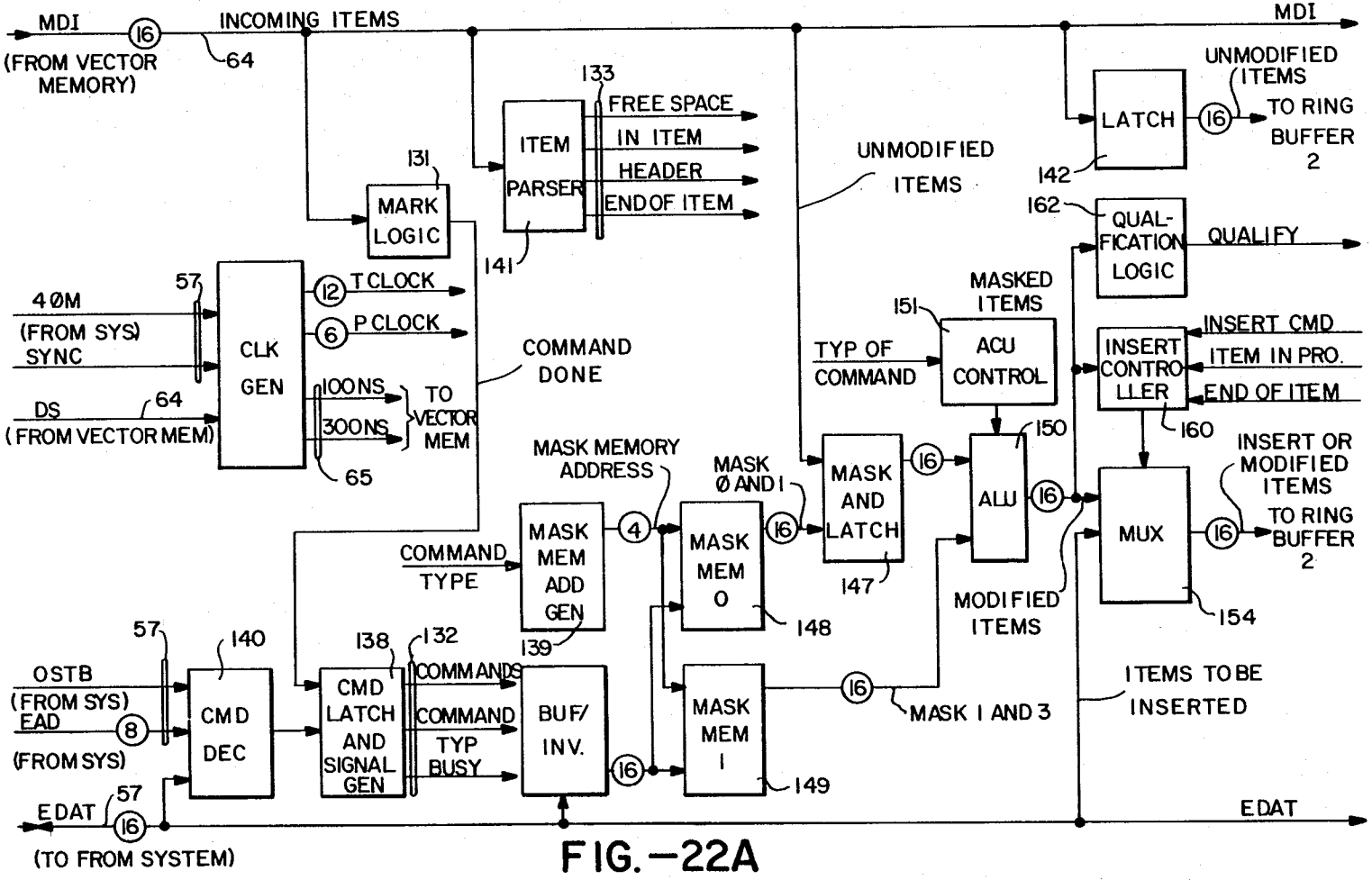
FIG. 22 depicts a block diagram of a memory update system which forms a portion of FIG. 2.
Figure 22B:
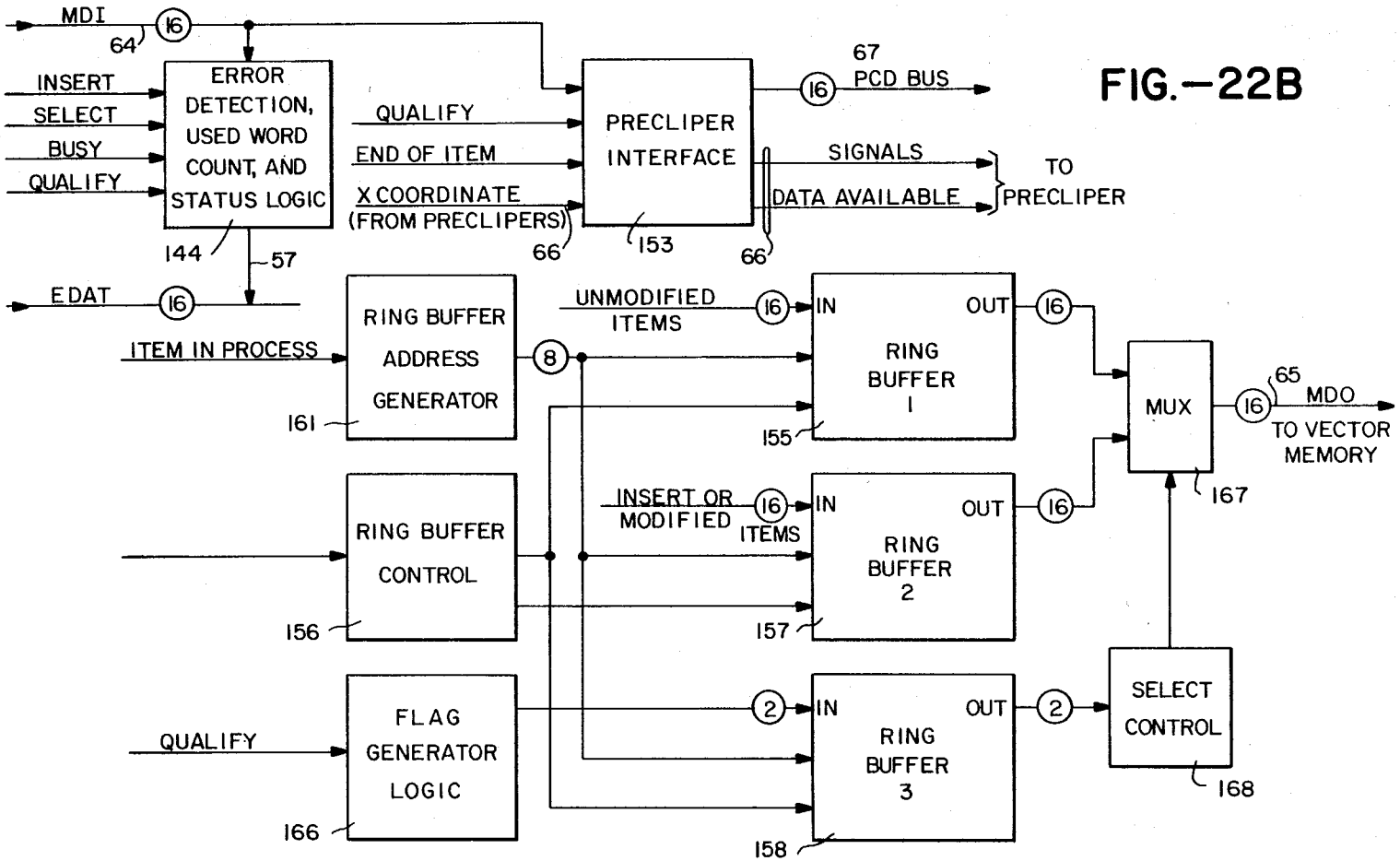
Figure 23:
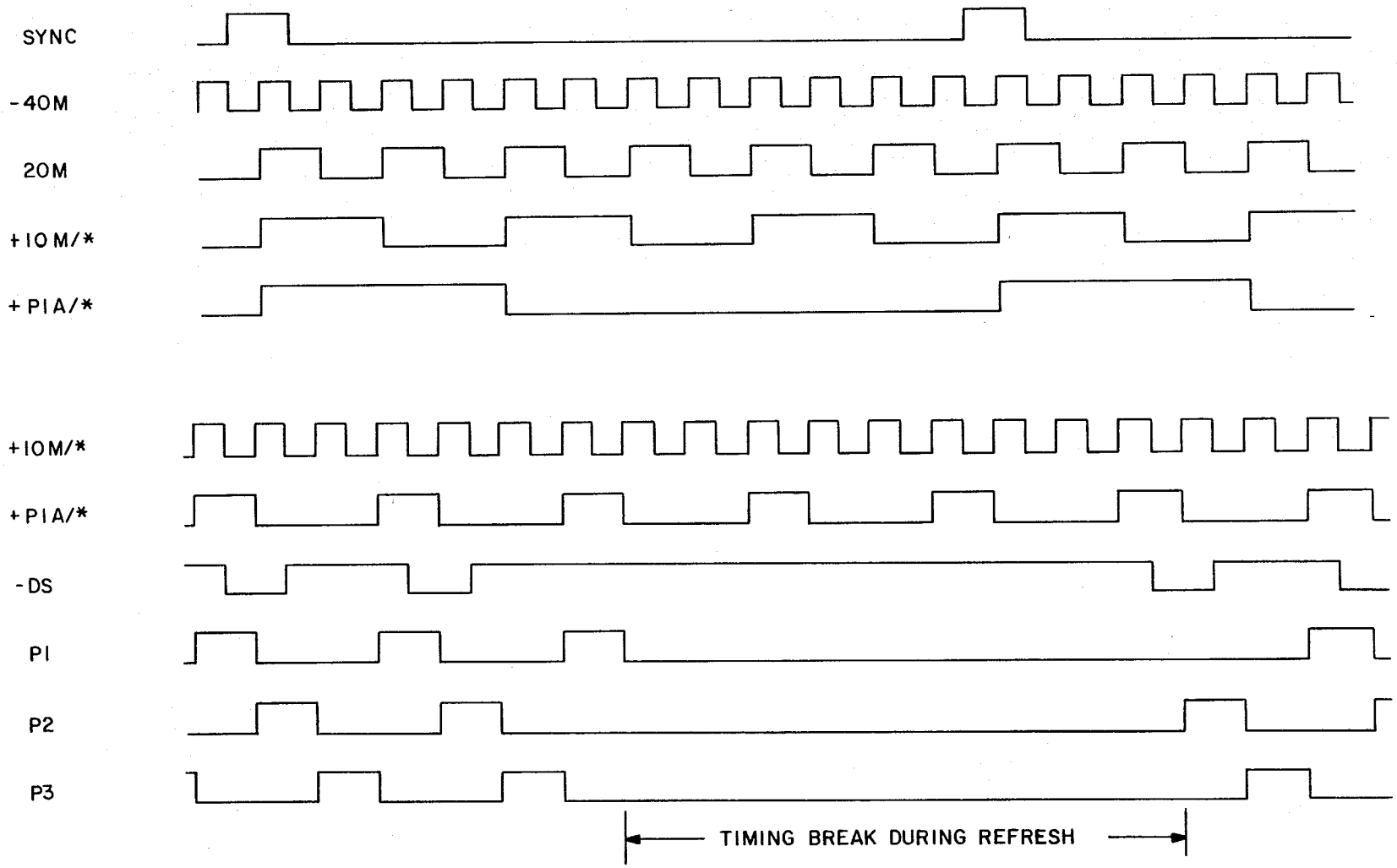
FIG. 23 depicts a timing diagram for the memory update system of FIG. 22.

The memory update system (MUDS) 60 of FIG. 2 is depicted in more detail in FIGS. 22A and 22B. The primary functions of MUDS circuit 60 are to insert data from the host CPU through command processor (CP) into vector memory 61, associatively search and modify items in memory 61 specified by the command processor, and to selectively pass data from memory 61 to preclipper circuit 62 for the set view and identify functions, to be described. Timing diagrams for illustrating the operation of MUDS 60 and memory 61 are depicted in FIG. 23.

In FIG. 22A, a command decoder 140 receives the OSTB and EAD signals and commands in the form of EDAT signals from the system on bus 57. Decoder 140 is connected to command latch and signal generator 138 which generates on bus 132 the commands, command type and busy signals.

The memory data in (MDI) bus 64 from memory 61 is connected to logic circuit 131 which waits for a command to be started. When free space or an end of item is detected, mark logic 131 sets a mark bit. The bit position in the first word of an item or free space is set and is called the mark bit. Mark logic 131 is connected to command latch 138 to inform latch 138 when a command is completed.

Item parser 141 is a logic circuit which determines the possible categories of a data word from vector memory 61 on MDI bus 64. Item parser 141 generates the FREE SPACE, IN ITEM, HEADER and END OF ITEM signals on bus 133.

MDI bus 64 is also connected to latch circuit 142 which sends unmodified items to ring buffer circuit 155 of FIG. 22B, which is a 256×16 bit buffer utilized for modifying, translating and deleting functions.

Polygon vector data from the command processor (CP) 50 is sent to the MUDS 60 circuit via bus 57 into buffer/inverter circuit 145 which in turn is connected to mask memory 148 (MM0) and mask memory 140 (MM1) which are 16×16 bit memories and which are addressed by mask memory address generator 139, which generates the necessary 4-bit address signals in response to a command type signal from command latch 138.

The 16-bit MASK0 and MASK2 items from memory 148 are latched to mask and latch circuit 147, which also receives unmodified items from the vector memory via bus 64. MASK1 and MASK3 items from memory 149 are connected to ALU circuit 150. The mask and latch circuit 147 is also connected to ALU 150, which processes the data under control of ALU control circuit 151, depending upon the type of command received from command latch 138.

Masked items from ALU 150 are connected to qualification logic circuit 162, which provides appropriate selection between the ring buffer circuits of FIG. 22B, depending upon the results of MASK0 and MASK1.

Modified items from ALU 150 are connected to multiplexer (MUX) 154, which also receives items to be inserted via bus 57 and connects the insert or modified items to ring buffer 157 (RB2) of FIG. 22B under control insert controller 160, which receives the INSERT COMMAND, IN ITEM and END OF ITEM signals from item parser 141 and command latch 138, respectively.

Referring now to FIG. 22B, ring buffer address generator 161 receives the IN ITEM signal from item parser 141 and provides 8-bit address signals to ring buffer 155, ring buffer 157 and ring buffer 158.

The ring buffer circuits of FIG. 22B are controlled by ring buffer control 156, which receives appropriate timing signals from clock generator circuit 130 of FIG. 22A.

Flag generation logic 166 receives the QUALIFY signal from qualification logic circuit 162 and IN ITEM, END OF ITEM and HEADER signals from item parser 141 of FIG. 22A and which effectively tells the ring buffer circuitry when to set flags.

Ring buffers 155, 157 (RB1 and RB2) are 256×16 bit ring buffers. Ring buffer 158 is a 256×4 bit ring buffer and ring buffers 155, 157, 158 are used for updating memory 61. Ring buffer 155 stores unmodified item(s), ring buffer 157 157 stores modified item(s), and ring buffer 158 is used to store ring buffer selection code from logic circuit 166. The 2-bit selection code from ring buffer 158 is connected to select control circuit 168. One bit is an enable flag in order not to change or modify an item in process. The other flag bit tells which ring buffer 155, 157 should be selected.

Multiplexer (MUX) 167 selects the data from either ring buffer 155 or 157 and sends the 16-bit data on bus 65 back to vector memory 61.

In FIG. 22B, the error detection, used word count and status logic circuit 144 receives the data from memory 61 together with the INSERT, DELETE, BUSY and QUALIFY signals from FIG. 22A to provide the appropriate control signals on bus 57.

Preclipper interface circuit 153 receives vector data on bus 64 together with the QUALIFY, END OF ITEM and X-COORDINATE signals. The X-COORDINATE signal on bus 66 from the preclipper circuit is an instruction requesting either the X or Y coordinate and in response thereto the MUDS circuit provides the appropriate coordinate on PCD bus 67.

Preclipper interface 153 also provides to the preclipper circuit the necessary data available signal on bus 66 together with the appropriate signals indicating end of item, short form data, header, qualify and which word of the item.

In FIG. 22A, the clock generator circuit 130 receives the 40M and SYNC signals from the system together with the DS (read) signal on bus 64 from the vector memory. The clock generator 130 generates the 100 NS, 300 NS signals and P clock signals depicted in FIG. 23, as well as the T clock signals (not shown).

The vector memory receives two clock inputs (differential pairs) for its basic timing from one of the MUDS 60 systems. Every 300 ns, a 16-bit word is stable at output bus 65 and the data can be latched by the read clock signal (DS) of FIG. 23. At the trailing edge of the DS signal, data on bus 65 to memory 61 must be stable for writing. In one embodiment, a memory 61 cycle is 300 ns long which is the period of the DS (read clock)

signal. At the end of the 32 cycles, memory 61 will go into a refresh or shift period which is 9.6 us long. During this period, the internal clocks of the MUDS re inhibited, which are designated P1, P2 and P3 of FIG. 23. All processing comes to a halt except that data from CP 50 can still be inserted from that time under control of the T clock signals (not shown).

In FIG. 22A, the command decode logic 140 decodes the different commands from the command processor via bus 57. The commands (depicted in Tables I and II) decoded are insert, delete if equal/not equal, modify if equal/not equal, translate if equal/not equal, identify if equal/not equal (including point, line and window identify), and set view if equal/not equal. The desired command is decoded upon the right combination of address and data signals followed by the OSTB signal. After the command is properly decoded, parameters accompanying the command are loaded by subsequent OSTB signals. The start signal initiates the processng of a command.

The status and used word count report circuit 144 reports the busy status, error status and number of words used in memory 61 to the command processor, via bus 57. MUDS 60 is busy as long as a command is in process. In the case of an insert command, the command is not done until all of the insert data is written into memory 61. If the word count of the items is less than four, a header length error is reported. If in long form, data length error is reported when the parity of the length of the item differs from that of the descriptor length. The used word counter is preset to zero during a memory 61 reset and decrements by the number of words deleted during a delete command and increments by the number of words inserted during an insert command. The count remains intact during all other operations.

In the case of modify and translate commands, the items with modified headers are written into ring buffer 157 while unmodified items are written into ring buffer 155. At corresponding locations in ring buffer 158, where the first words are in ring buffers 155, 157 respectively, bit zero is set, and bit one is set so that ring buffer 157 will be chosen for writing into memory 61 if the item satisfies the qualification test. Ring buffer 157 is also used for data insertion into memory 61. Insert data from command processor 50 is loded into ring buffer 157 and as soon as a word of free space or end of item from memory 61 is detected, inserted data in ring buffer 157 is written into memory 61.

There are two read pointers (RP and IRP), two write pointers (WP and IWP) and a header pointer (HP). RP points to a location in a ring buffer where the next word from memory 61 will be stored. WP points to the location in a ring buffer from which the next word written into memory 61 is retrieved. RP and WP are used by both ring buffers 155, 157. IRP and IWP are used only during an insert command by ring buffer 157. HP is used to keep track of the first word of the current item in ring buffers 155, 157 and is selected to address ring buffer 158 for recording the first word and ring buffer selection flags. WP is selected for reading the flags from ring buffer 158.

In FIG. 22A, the mask memories 148, 149 are loaded with the masks during command parameter load (MASK LOAD IN PROGRESS-MLIP). The mask memory and address assignments for the four are as follows:

| MASK | MASK MEMORY | ADDRESS |
|---|---|---|
| Ø | Ø | 0–5 |
| 1 | 1 | 0–5 |
| 2 | Ø | 8–D |
| 3 | 1 | 8–D |

MASK0 ad MASK2 are stored in memory 148 in one's complement form so that an effective ANDing function is performed on the latched area. The following functions are performed:

(1) (MASKØ·DATA⊕MASK1
(2) Record above result and do qualification test.
(3) RB2←(MASK2)·DATA⊕ (or PLUS) MASK3.
(4) Select RB2 output for memory input data if the item passes qualification test. Otherwise RB1 is selected. (RB1←DATA is done every cycle).

The preclipper interface circuit 153 provides the input data for the preclipper along with various timing and state signals. A 16-bit word is sent to the preclipper circuit 62 if the word just received by the MUDS from memory 61 is part of an item. For coordinate data, the word can be sent in three ways, which are:

(1) Unmodified if data is in long form.
(2) Lower eight bits shifted left with sign extension by the value in short exponent, if data is in short form and XSEL is low.
(3) Upper eight bits shifted left with sign extension by the value in short exponent, if data is in short form and XSEL is high.

The fact that insert data is sent to the vector memory 61 when free space or the end of an item is detected allows the MUDS circuit to handle its own "garbage collection" without imposing an overhead penalty. New data is inserted into the vector memory in place of unused or free space or in between existing items. Thus, new data can be inserted into the vector memory regardless of the distribution of items throughout the memory as long as the total number of words inserted does not exceed the capacity of the vector memory.

The significance of the read pointer and write pointer is that it allows the ring buffers to act as FIFO (first in first out) registers, with an important advantage. When a FIFO register is filled, its internal address is incremented from a zero (empty) to some maximum count (full). As data is read out, the internal address is decremented until zero is reached again. Therefore, a FIFO requires special logic to keep from counting below zero or above the maximum value. However, the ring buffers overcome this problem by limiting the size of items going into the ring buffer to less than the maximum ring buffer size. The ring buffers are also arranged so that the data will be read out of the ring buffers fast enough so that they will never be completely filled. Consequently, MUDS 60 needs only to detect when the buffers are empty. Instead of using address zero to indicate "empty," the ring buffer address is allowed to take any value and two pointers are used.

When data is written into the ring buffers, the read pointer is incremented by one to the address into which the data will be written and as data is being read out of the ring buffers, the write pointer is incremented by one to the address from which data will be read. When the two pointers are equal to each other, the ring buffer is empty.

If both pointers are incremented enough, the ring buffer address eventually will return to where it started, hence the name ring buffer. Since the ring buffer logic need only detect the case of the two pointers being equal, the control logic is simplified over the FIFO type of register.

In the MUDS circuit, the items in the vector memory can be inserted, associatively modified, and/or passed to the preclipper circuit regardless of their distribution or relative position in the vector memory. As long as the number of items inserted into the vector memory do not exceed the capacity of the vector memory, the MUDS circuit will find spaces to insert new items, process existing items and perform the "garbage collection" technique described above as the items serially circulate through the MUDS circuit.

Vector Memory

In one embodiment, vector memory 61 is a 64K-word×16-bit charge coupled device (CCD) memory. The memory storage area includes 64 serial memory devices arranged in four banks. The memory is addressed sequentially and operates in an interleaved mode, with a read operation performed in one bank while a write operation is performed on another bank. The sequencing of the operation thereby allows a read-modify-write operation to be performed at each memory location in turn. The memory has a sequentially interleaved average data rate of 300 nanoseconds (ns). However, it is to be understood that other types of known memories can be included within the scope of the present invention. For example, magnetic bubble memories (MBM) or random access memories (RAM) could be utilized for vector memory 61.

In one embodiment the CCD memory devices include 64 256-bit chip registers which are addressed serially under control of a four-phase clock input. The data in the chip register is shifted every 32 cycles (i.e., every 10 microseconds) to refresh data, and to bring data into an access position. The memory has a 900 ns data gap during a shift operation. Since the memory has 64K data locations, the maximum period required to read and write the entire memory is 24 ms.

Figure 24:
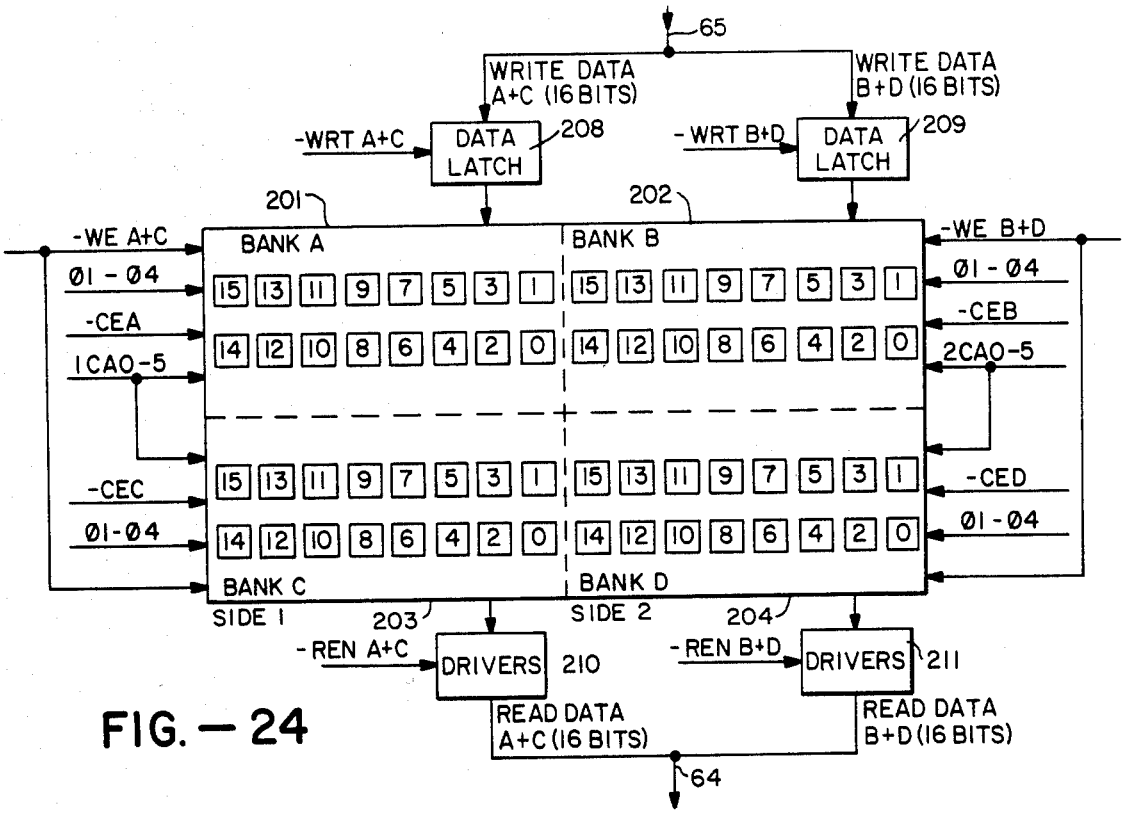
FIG. 24 depicts a block diagram of a vector memory, which forms a portion of FIG. 2.

Memory 61 receives clock inputs from the MUDS and from these inputs generates required control and mode signals. All addrss bits are internally generated. In FIG. 24, there are 16 write data lines forming bus 65 from the MUDS to latches 208, 209 to memory 61 and 16 read data lines from the memory 61 to MUDS 60 via drivers 210, 211 and bus 64.

The memory storage area includes 64 16K-word by 1-bit charge-coupled (CCD) serial memory chips, such as Intel's model 2416. The chips are arranged in four banks 201–204, as depicted in FIG. 24, in which each bank stores 16K 16-bit words.

In the interleaved mode, a read-modify-write operation is performed at each memory location in turn. In FIG. 24, a read operation is performed in one bank of memory such as bank 201 (bank A) while a write operation is performed at another bank such as bank 204 (bank D). A write operation is then performed in the bank from which data has just been read out, at the same address, to complete the read-modify-write operation at that location. While this write operation is going on, a read operation is being formed at another bank. A basic cycle time for memory 61 is 300 ns, which in effect allows a read-modify-write operation to be completed every 300 ns.

Figure 26:
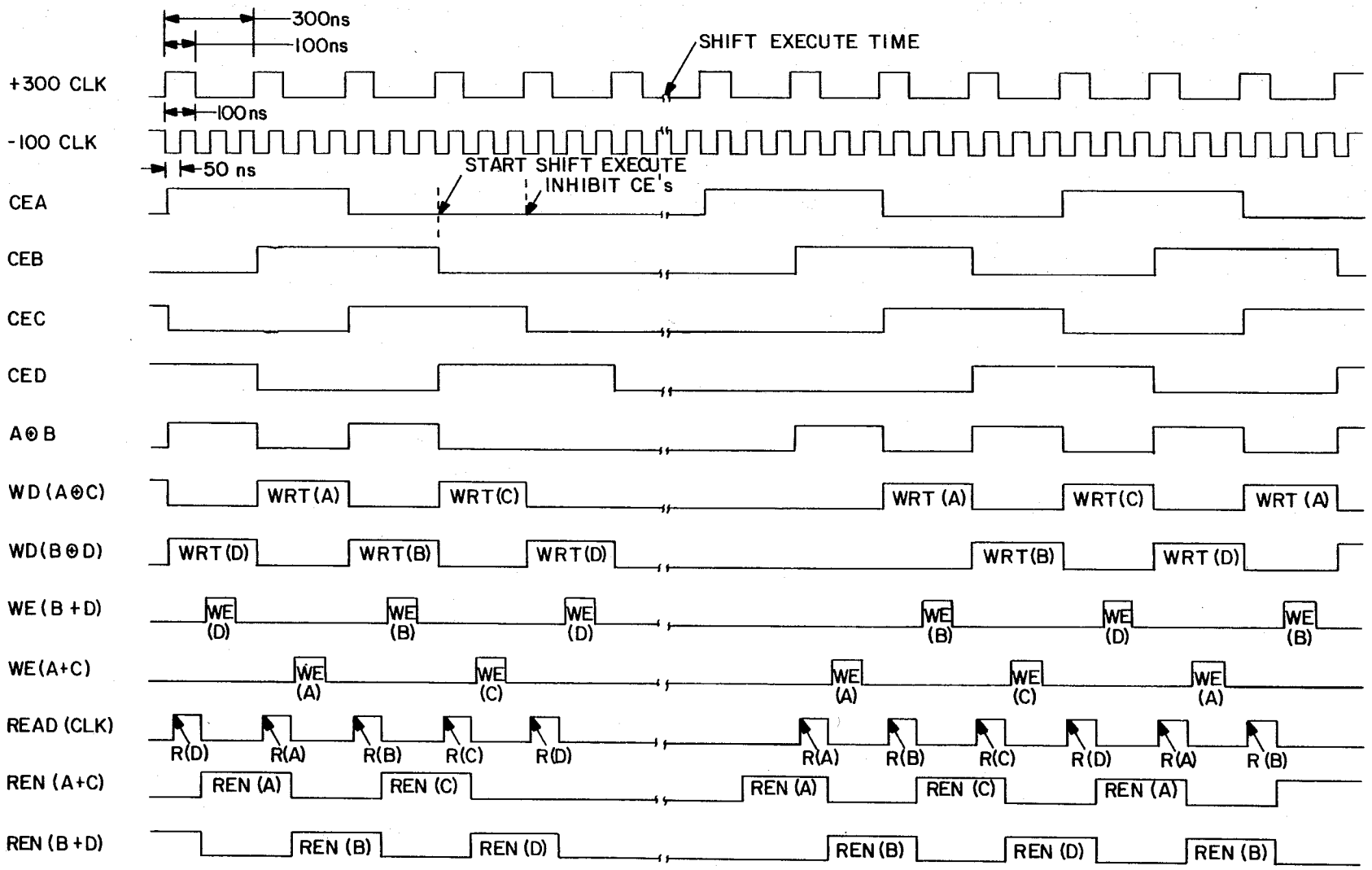
FIG. 26 depicts a timing diagram for the memory of FIG. 24.

For a first functional cycle, bank 201 is enabled by the -CEA signal, for a read operation, while a write operation is going on in bank 204 (enabled by -CED). At the next cycle, bank 202 is enabled for a read operation by -CEB. -CEA is still active and a write operation is performed in bank 201, at the same address as the read operation. 300 ns later, a read operation is initiated in bank 203, when -CEC goes low, while a write operation is then performed in bank 204, while a write operation is going on in bank 203. The timing requirements for these operations are depicted in FIG. 26.

These procedures are repeated until a read-modify-write operation has been performed in all 64K chip locations. A 1.2 us refresh operation occurs at the end of every 32nd cycle which provides a refresh cycle time of 9.6 us.

Figure 25:
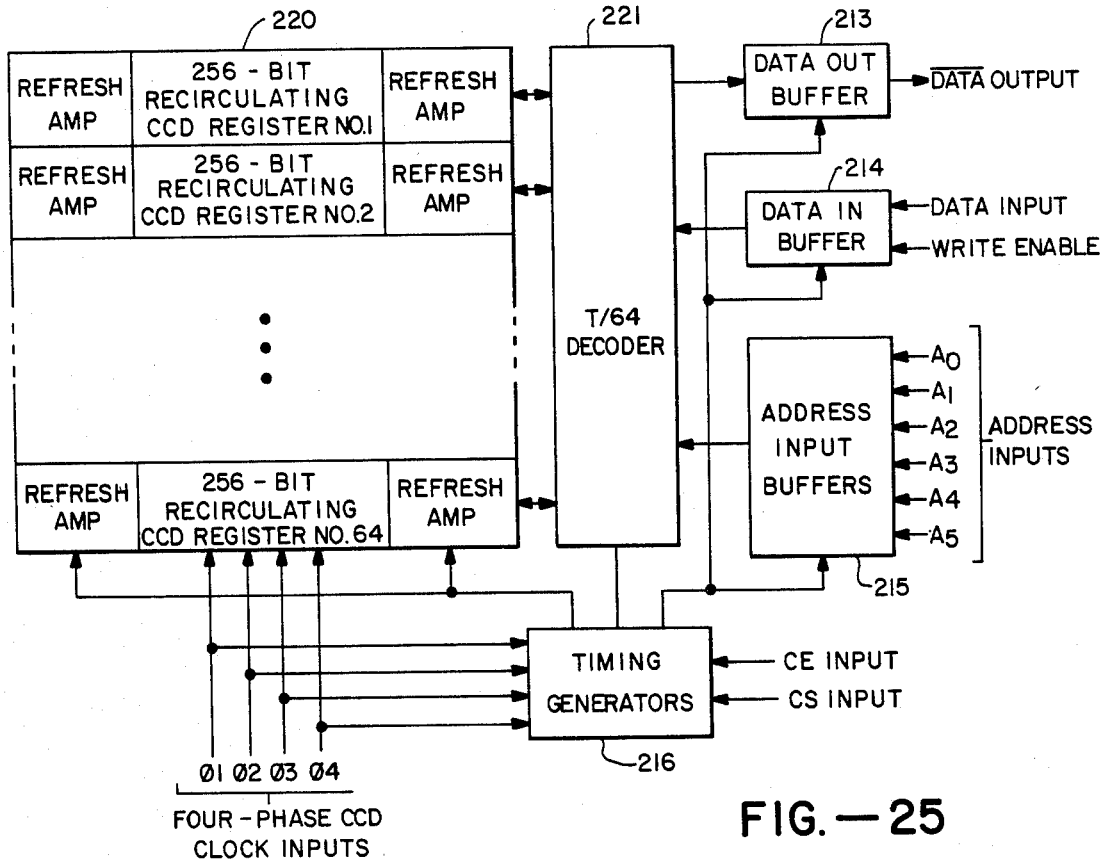
FIG. 25 depicts a block diagram of a memory chip of the vector memory of FIG. 24.

FIG. 25 depicts a block diagram of 64 recirculating shift registers 220 of 256 bits each. Address bits for banks 201 and 203 and for banks 202 and 204 are internally decoded to select one of those 64 registers. The chip registers 220 are grouped in blocks of 8 (0–7, 8–15, 16–23, 24–31, 32–39, 40–47, 48–55, and 56–63). Decode signals A3 A5 into buffer 215 are decoded by decoder 221 to select one of these eight blocks and address signals A0–A2 are decoded to select one individual register out of the eight in the block.

One bit out of 256 in the selected register is addressed by shifting the data in register 220 to bring the required bit into the access position in buffer 313. Data are input to a selected register via buffer 214. Shifting is controlled by four phase clock inputs 1–4. Timing generator 216 controls internal timing. With interleaving, one bit is accessed in each of the 32 chips during each cycle, thereby allowing one 16-bit word to be read out from and one 16-bit word to be written into the desired locations.

Preclipper

Figure 27:
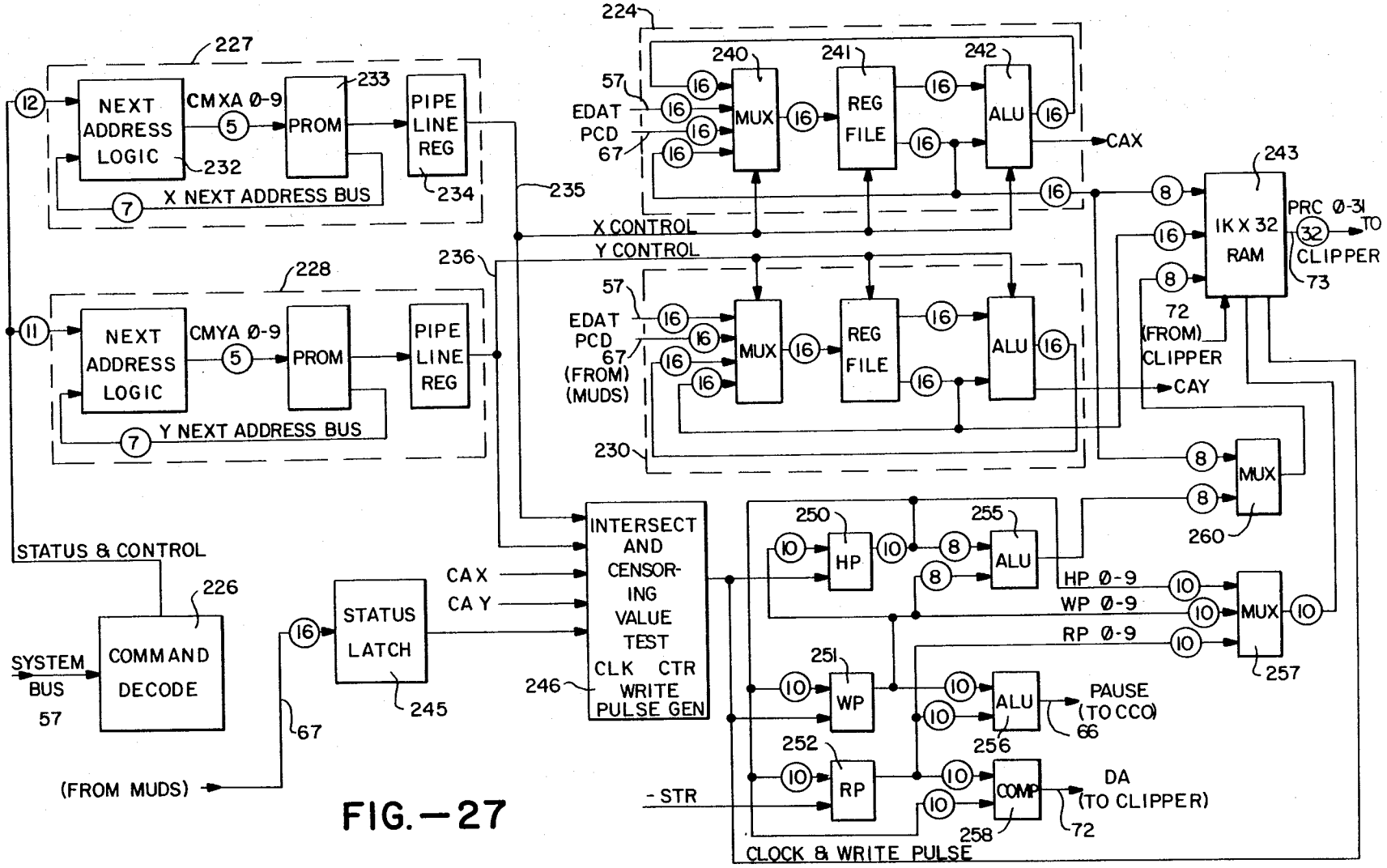
FIG. 27 depicts a block diagram of a preclipper circuit, which forms a portion of FIG. 2.

The preclipper circuit 62 of FIG. 2 is depicted in more detail in FIG. 27, and includes a command decode circuit 226 for receiving status and control signals from the command processor via system bus 57. The preclipper includes two coordinate control units 227, 228 (which are control units for the X and Y coordinates, respectively) and two coordinate processor units 229, 230 (which are processor units for the X and Y coordinates, respectively).

Each control unit 227, 228 includes a next address logic circuit 232, control storage (PROM) 233 and a pipeline register 234. Each processor unit 229, 230 includes a four to one (16-bit) MUX 240, an 8×16 register file 241 and a 16-bit ALU 242. Each regiser file 241 has one input port from MUX 240 and two output ports. One of the two output ports of register file 241 is connected directly or indirectly (through MUX 240) to a 1K×32 bit output buffer (RAM) 243.

X-control signals on bus 235 and Y-control signals on bus 236 from control units 227, 228, respectively, are input to the respective processor units 229, 230. Data from the MUDS circuit via 16-bit bus 67 are also input through status latch 245 into intersect and censoring value test circuit 246, which also has inputs from control units 227, 228 and from processor units 229, 230. Outputs from test circuit and clock generator 246 are input to header pointer (HP) circuit 250, write pointer (WP) circuit 251 and read pointer (RP) circuit 252.

The HP 250 output is input to ALU circuit 255 and into WP circuit 251, MUX 257, and RP 252. The WP 251 output is input to ALU circuit 257 and also input to HP 250, ALU 255 and MUX 257. The output of RP 252 is input to comparator (COMP) 258, ALU 256 and MUX 257.

The output of ALU 255 is input to MUX 260 which also receives 8-bits from register file 241. The output of MUX 260 forms an input to RAM 243. The output of MUX 257 forms an input to RAM 243 and an output of test circuit 246 is input to RAM 243.

The preclipper 62 functions are to accumulate the relative coordinates received from the MUDS 60 to make them absolute, to compare line segment deltas with the censoring value received for the current set view to determine whether the current point needs to be retained in output buffer 243, and to determine whether a particular polygon intersects a viewport or window. The intersection test in circuit 246 works in the following manner:

Let the window be defined by (XL, YL) and (XH, YH). Let the smallest rectangle that circumscribes the polygon be defined by (XMIN, YMIN) and (XMAX, YMAX).

If XMAX<XL
or XMIN>XH
or XMAX<YL
or YMIN<YH,
then the polygon is outside of the window.

FIG. 27A depicts an illustration of a circumscribed polygon, in which polygon 270, formed by a series of vectors, is circumscribed by a rectangle 271 defined by (XMIN, YMIN) and (XMAX, YMAX). Window 272 is defined by (XL, YL) and (XH, YH). Although it can be seen that polygon 270 does not intersect window 272, its circumscribed rectangle 271 does intersect window 272, so polygon 270 is passed to clipper circuit 70. Clipper circuit 70 subsequently determines that no segment of polygon 270 is visible. Note that, while preclipper 62 may pass polygons to clipper 70 which do not intersect the window, preclipper 62 never fails to pass a polygon to clipper 70 which does intersect the window.

Preclipper 62 receives polygon data from MUDS 60 at a rate of either one or two words per 300 us cycle. Specifically, two words per cycle are received if the data represents an X-Y coordinate pair which was originally encoded in short form within vector memory 61; otherwise, one word per cycle is received. A central processing section for the preclipper, as previously mentioned, includes control units 227, 228 and processor units 229, 230. Buffer 243 is addressed by the three pointers HP 250, WP 251, RP 252 via MUX 257. The header pointer (HP) points to the first word of the polygon under consideration being accumulated in the output buffer 243 and going through the intersection test by test circuit 246. The read pointer (RP) points to the location in output buffer 243 where the next word is to be retrieved by the clipper circuit 70. The write pointer (WP) points to the location in the output buffer 243 where the next 32-bit word is written by the preclipper circuit 62.

The 300 ns between successive words from MUDS circuit 60 is divided into three 100 ns periods called P1, P2 and P3 as depicted in FIG. 28. Data is stable for the preclipper 50 ns after the leading edge of P2. The three pointers HP, WP, and RP are time multiplexed in MUX 257 for addressing the output buffer 243 by P3 for HP, P1 for RP, and P2 for WP. When RP=HP, the data available (DA) signal would be low, which indicates that output buffer 243 is empty. Otherwise the DA signal is high. When $(RP-WP) \leqq 32$ a pause signal from circuit 256 on bus 66 will be raised to initiate the CCD pause cycle previously described.

The preclipper circuit 62 decodes two commad classes, which are set view and identify. Data from MUDS 60 is processed differently according to whether the word received belongs to the header or is a coordinate as described in conjunction with the polygon format.

In case of an identify function, the whole header is sent to buffer 243. For a set view function, only the first two words of the header are stored in output buffer 243 with the actual number of 32-bit words stored in the word count field of the header.

The micro-instruction cycle is 50 ns. In FIG. 27, the X-processing unit 229 runs for six cycles (300 ns) and the y-processing unit 230 runs for six cycle. In the case of short form data, the X and Y units 229, 230 run in parallel with a skew of 50 ns. The pipeline registers in units 227, 228 are used to allow overlap of the execution and instruction fetch cycle, as depicted in FIG. 28, in which E signifies execution of an instruction fetched during the last fetch cycle and F signifies instruction fetch. During the course of processing coordinate data for a set view command, the arithmetic operations involved for X (and analogously for Y) are as follows:

(1) I←input from MUDS
(2) X←X+I
(3) $|\Delta XP| \leftarrow |X-XP|$
(4) Compare $|\Delta XP|$ with CN
(5) Compare X with XL
(6) Compare X with XH

| Variable Names | Description |
|---|---|
| I | Input data from MUDS |
| X | Current X coordinate |
| $\|\Delta XP\|$ | Absolute value of X-XP |
| XP | Previous X coordinate |
| CN | Censoring value |
| XL | X low limit |
| XH | X high limit |
| Y | Current Y coordinate |
| $\|\Delta YP\|$ | Absolute value of Y-YP |
| YP | Previous Y coordinate |
| YL | Y low limit |
| YH | Y high limit |

In addition to the operations described above, preclipper 62 loads the XP and YP registers with the contents of X and Y, respectively, on the last 50 us cycle used to process a coordinate pair, if X differs from XP or Y differs from YP by at least the censoring value CN.

The processing performed for identify commands is similar to that for set view commands, except that all operations pertaining to censoring value CN are omitted.

FIG. 29 depicts the timing considerations and sequence of operation for the preclipper circuit according to the arithmetic operations involved. During time P2, the write ponter WP is selected for the address in output buffer 243. If either $|\Delta XP|$ or $|\Delta YP|$ is greater than the censoring value, the current pair of coordinates is written into the buffer. During time P3, the header pointer is selected. If intersection is detected, then after the end item (EI) signal or the pen up (PU) signal is received, the word count in the header will be updated and the header pointer will be set to the write pointer, thus making the data pertaining to the currently processed entity available to the transformation subsystem 53;

otherwise the write pointer will be set to the header pointer, thus discarding this data.

In FIG. 27, data from the preclipper buffer 253 is output on 32-bit bus 73 to the clipper circuit 70, and includes 16 bits of X-coordinate data and 16 bits of Y-coordinate data.

Clipper Circuit

Figure 30:
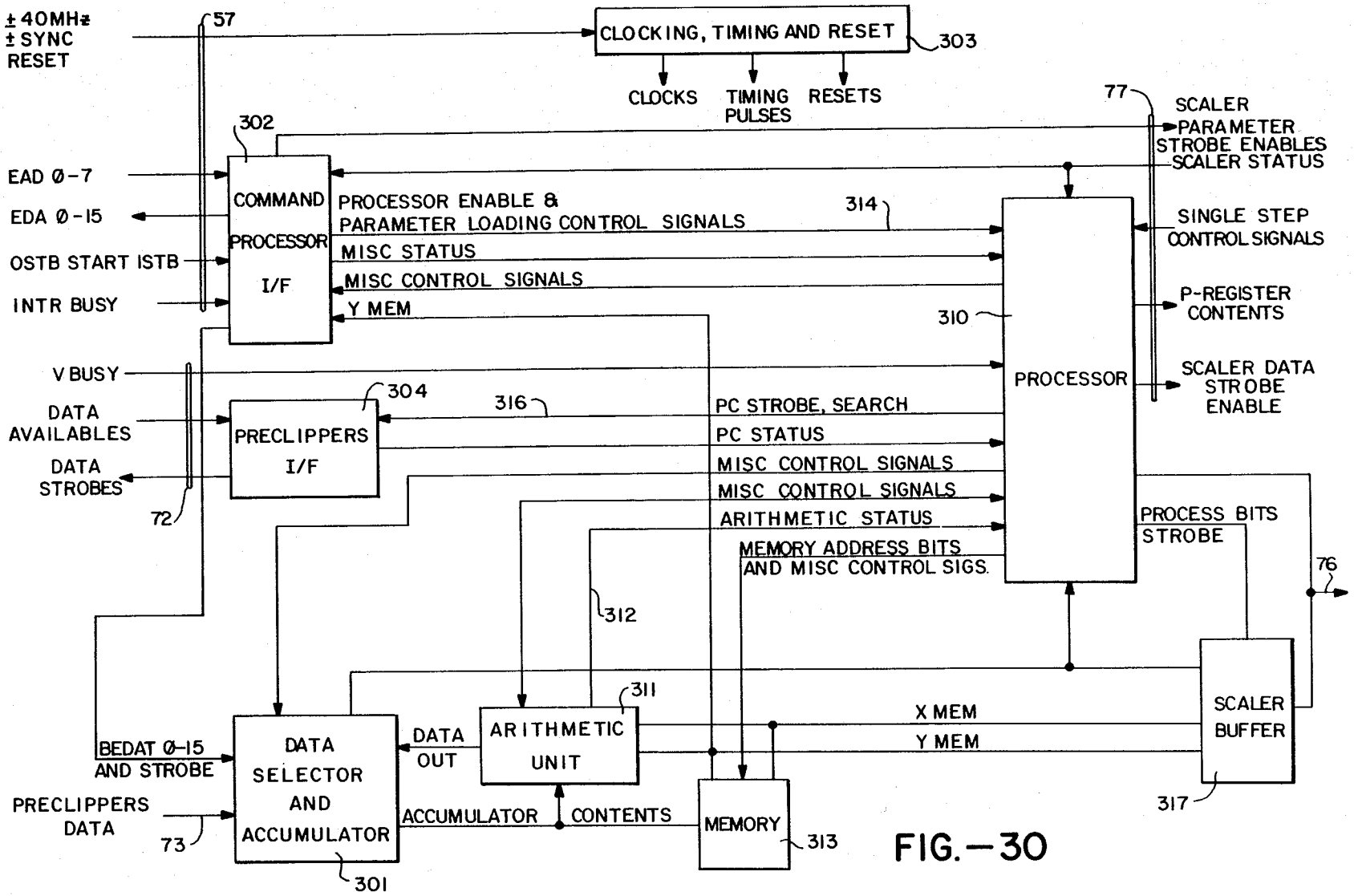
FIG. 30 depicts a block diagram of a clipper circuit, which forms a portion of FIG. 2.

The clipper circuit 70 of FIG. 2 is depicted in more detail in FIG. 30, in which preclipper vector data via bus 73 are input to data selector and accumulator 301. Control signals are input on bus 57 into command processor interface 302 and into clocking, timing and reset circuit 303, which provides appropriate timing signals for the clipper circuit. Preclipper control signals via bus 72 are input to preclipper interface circuit 304. The clipper 70 provides the clip and identify functions.

Clipper processor 310 contains a program register, a 256-word×48-bit PROM and other control logic for supervising clipper activities during the processing of data.

Data selector and accumulator 301 receives preclipper data via bus 73 and from other sources to be described, and stores data in the accumulator portion.

Arithmetic unit 311 is used to manipulate and compare data words, and the results are passed to the processor 310 via bus 312. Memory 313 holds parameters received from command processor 50 of FIG. 1, data currently being processed, and other words used in computations and all the header words to be sent to the command processor.

Figure 31:
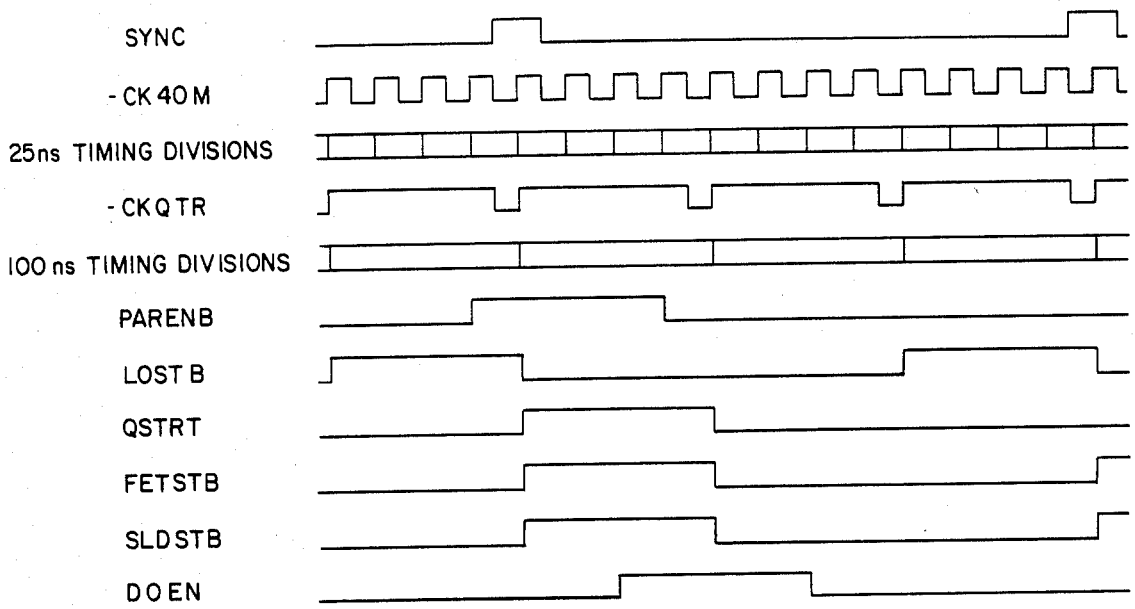
FIG. 31 depicts a timing diagram for the clipper circuit of FIG. 30.

FIG. 31 depicts the basic timing signals utilized in FIG. 30. The SYNC, 40 MHz, and 25 ns timing designations have been previously described. The CKQTR and timing signals are utilized by some of the logic for timing purposes. The remaining signals are not necessarily periodic and are shown for explanatory purposes.

The PARENB signal is used to enable the loading of command processor parameters in the clipper and scaler circuits. The LOSTB signal is a 100 ns synchronous image of the OSTB signal. The QSTRT signal is a 100 ns synchronous image of the CP's start signal. The FETSTB signal is a strobe sent to the preclipper to fetch data. The SLDSTB signal is a scaler data strobe enable signal. The DOEN signal is a strobe used to load header words onto the EDAT data lines.

In FIG. 30, the command processor interface 302 receives and interprets commands on bus 57 from the command processor 50, supervises the loading of command processor parameters for both the clipper and scaler. It turns the processor 310 on via bus 314 in response to an appropriate start pulse from CP and turns processor 310 off in the case of a succeeding command occurring while processor 310 is still processing data, and specifies which of the five functions of processor 310 is to carry out.

The preclipper interface 304 monitors the data available signals from a preclipper circuit via bus 72 and selects one from which the clipper circuit will receive data for a given system. When the processor in 310 is about to finish processing a given entity, it sends the search signal on bus 316 to interface 304, informing it to select another preclipper.

Since the clipper circuit includes a path for X-coordinate data and for Y-coordinate data, FIG. 32 depicts one half of the clipper circuit data path. Data is selected from one of four sources in FIG. 32, which are the command processor via bus 57 and buffer 327, the preclipper via bus 73 and buffer 328, the other accumulator data path via bus 331 and buffer 329, and the ALU circuit 326 and inverter circuit 325.

Command processor data from buffer 327 are selected from the interface 302 circuits of FIG. 30 before the processor 310 is turned on. Preclipper data from buffer 328 are selected whenever a fetch strobe to a preclipper is issued. Data from the other accumulator via buffer 329 or from the ALU 326 and inverter 325 are selected by control signals from processor 310.

In FIG. 32, the ALU 326 and inverter 325 perform the off (unselected), increment accumulator, add memory to accumulator, subtract memory from accumulator, invert result if negative, select memory, and select accumulator functions.

Selected data are fed to the accumulator 330. X-selected data are also fed to a process bits register (not shown) which also holds the screen space bit. Y-selected data are also fed to word counters (not shown), which monitor header and all words in an entity. The contents of the process bits register form part of the data sent to the scaler circuit 71. Accumulator 330, in addition to holding data, can be right shifted one bit. A right-shift immediately following an ALU summing provides the SUM/2 function.

In FIG. 32, each comparator 335, 337 has an accompanying one-word register 334, 336 loaded from memory 333. Registers 334, 336 contents are compared to the accumulator 330 contents and the results are sent to logic in the arithmetic unit where they are analyzed and compared with previous such results. Processor 310 circuit of FIG. 30 makes decisions on the results of such testing.

The X-memory of a clipper data path has a capacity of 16 words. The Y-memory, which is also used to store header words, has a capacity of 256 words. In addition to feeding the items already mentioned, the memory is the source for coordinates sent to the scaler circuit. The Y-memory, in addition, must feed the EDAT data lines in order to flush the buffers. During the storing and flushing of header words, the X-accumulator addresses the Y-memory via bus 339, controlling where in the Y-memory the headers are stored. Two address pointers are maintained in the X-memory.

FIG. 33 depicts the processor 310 circuit of FIG. 30 in further detail. Processor 310 includes an 8-bit P-register 345 which feeds a 256-word×48-bit PROM. Five of the PROM 346 bits select one of up to 32 signals, the state of which will select between two possible next addresses. Each processor state generates a series of commands which are summarized below.

| COMMAND | # BITS | COMMENTS |
|---|---|---|
| MEMORY | 6 | Provides four bits of Memory addressing and separate enables for writing the X and Y Memories. |
| ACCUMULATOR & ALU | 8 | Directs separately the loading of the X and Y Accumulators. Provides for selecting the other Accumulator for data input. Supervises ALU operation. Provides for shifting the Accumulators. |
| SPECIAL COMMANDS | 5 | Selects one of 32 mutually exclusive special commands. These among other duties operate various Processor status flip-flops load registers in the data path, and terminate Processor operation. |
| MISC BITS | 6 | Generates six signals, which |

-continued

| COMMAND | # BITS | COMMENTS |
|---|---|---|
| | | among other duties, generate the PRECLIPPER fetch strobe and the SCALER data strobe enable and load registers in the data path. |

Referring again to FIG. 30, the functions of the clipper will be described in more detail. The clipper lies in the data path between the preclipper circuit 62 and the scaler circuit 71. The clipper performs five functions which are set view (CLIP), identify point, identify segment, identify window partial, and identify window full.

During the CLIP function, the clipper receives data preselected and modified by the preclipper circuit. For each data entity delivered to the clipper, a special single 32-bit header word is received followed by a number of 32-bit coordinate-pair of words. The special header contains the following items sensed by the clipper of FIG. 30, which are:

| ITEM | # BITS | COMMENTS |
|---|---|---|
| SIZE | 8 | Specifies the number of 32 bit words, including the header, to be sent to the CLIPPER for that entity. |
| SCREEN SPACE | 1 | Differentiates between Screen Space and Drawing Space. |
| PROCESS BITS | 6 | Auxiliary data passed to the WRITE BOARD via the SCALER. |

Prior to the execution of the CLIP or set view command, the command processor 50 of FIG. 1 issues a series of parameters of which the following are sensed by the clipper:

| PARAMETER | COMMENTS |
|---|---|
| XL | X coordinates defining left boundary of CLIP window. |
| YL | Y coordinates defining lower boundary of CLIP window. |
| XH | X coordinate defining right boundary of CLIP window. |
| YH | Y coordinates defining upper boundary of CLIP window. |
| XMT, YMT, MULTIPLY & SHIFT | SCALER parameters. The CLIPPER detects the issuance of these and via appropriate control signals directs the scaler to strobe these into the appropriate registers. |

During the set view execution, for all entities with the screen space bit true, each coordinate-pair is passed on to the scaler circuit unmodified. PEN is UP for the first pair of each such entity and DOWN for the remaining.

For all entities with the screen space bit false, each coordinate-pair is considered in relationship to the previous coordinate-pair (if any) and to the window. A series of coordinate-pairs and PEN commands is generated and sent to the scaler so that that portion of the entity line on or within the window can be reproduced on the screen.

During the point-identify function, the clipper receives data preselected and modified by the preclippers. For each data entity delivered to the clipper circuit, the unmodified group of header words are received, each 16-bit word one by one, on the Y portion of bus 73. A size byte with the same format as in set view is received via the X portion of bus 73 at the same time as the first header word is received. Also, the $X_0$ coordinate is received via the X portion of bus 73 at the same time as the $Y_0$ coordinate is received. These are followed by the coordinate pairs received as 32-bit words, as in the set view function, beginning with the coordinate pair $X_1$, $Y_1$. This scheme applies to both short and long form data.

Just prior to the execution of the point-identify command, the command processor issues a series of parameters of which the following three are sensed and used by the clipper:

| PARAMETER | COMMENT |
|---|---|
| XID | X coordinate defining identify origin. |
| YID | Y coordinate defining identify origin. |
| FFFFH | First delta ($= 2^{16} - 1$). |

During point identify execution, the following actions are taken by the clipper circuit:

1. The complete header of the entity being received is stored in the Clipper memory.
2. For each coordinate-pair received,
   a. $\Delta X(=|X-XID|$ and $\Delta Y(=|Y-YID|)$ are formed.
   b. The greater of $\Delta X$ and $\Delta Y$ is compared with the stored delta (initially, the First Delta, $2^{16}-1$).
   c. If it is less than the stored delta, it replaces the stored delta, and the current entity is marked as a HIT.
3. After all coordinate-pairs for a given entity have been analyzed, if the entity has not been marked as a HIT, its header will be discarded. If the entity has been marked as a HIT, the header group for the previous HIT entity will be discarded.
4. When the CLIPPER detects the condition in which no more data is forthcoming, it interrupts the command processor, which then fetches from the CLIPPER a size word, indicating the total number of words to be sent, and the complete header of the entity last marked as a HIT.

The segment identify function is a refinement of the point identify function and the same parameters are used in the treatment and disposition of headers. Action taken on received coordinate pairs is as follows:

1. A point identify routine (equivalent to that described above) is applied to the first coordinate of each entity.
2. For each succeeding point (let P represent the previous coordinate pair, C the current, and PC the line connecting them):
   a. If PC crosses neither $X=XID$ or $Y=YID$, a point identify is applied to C.
   b. If PC crosses one of the axes and is orthogonal, a delta is formed equal to the magnitude of the distance between the axis intercept and the identify origin. If this delta is less than the stored delta, it replaces the stored delta, and the current entity is marked as a HIT.
   c. If PC is a diagonal and, crosses $X=XID$ only, with a slope $>1$, or crosses $Y=YID$ only, with a slope $\leqq 1$, then a point identify is applied to C.
   d. If PC is a diagonal and crosses $X=XID$ with a slope $\leqq 1$, the intercept on $X=XID$ is computed. If PC is a diagonal and crosses $Y=YID$ with a slope $\leqq 1$, the intercept on $Y=YID$ is computed. In either case a delta is formed equal to the magnitude of the distance between the axis intercept and the identify origin. If this delta is less than the stored delta, it replaces the stored delta, and the current entity is marked as a HIT. Then a point identify is applied to C.

During the identify window partial function, the clipper receives data preselected and modified by the preclippers and the format is the same as for the point and segment identify functions. The above described parameters XL, YL, XH and YH are received and stored prior the execution of the command. During the partial window identify function, the following actions are taken by the clipper:

1. The complete header of the entity being received is stored in the CLIPPER memory.
2. If the first coordinate-pair lies on or within the window, the entity is marked as a HIT.
3. If any successive coordinate-pair lies on or within the window or if the line connecting any point, other than the first, with the previous point intersects the window, the entity is marked as a HIT.
4. After all coordinate-pairs for a given entity have been analyzed, if the entity has not been marked as a HIT, its header will be discarded. Otherwise, it will be retained along with the headers for any previous HIT entities.
5. Whenever the CLIPPER memory contains 224 or more header words or the CLIPPER detects the condition in which no more data is forthcoming, it interrupts the COMMAND PROCESSOR, which then fetches from the CLIPPER a size word, indicating the total number of words to be sent, and then all the header words stored.

The identify window full function differs from partial window identify in that an entity is considered within a window only if all coordinate pairs lie on or within the window.

Scaler Circuit

Figure 34:
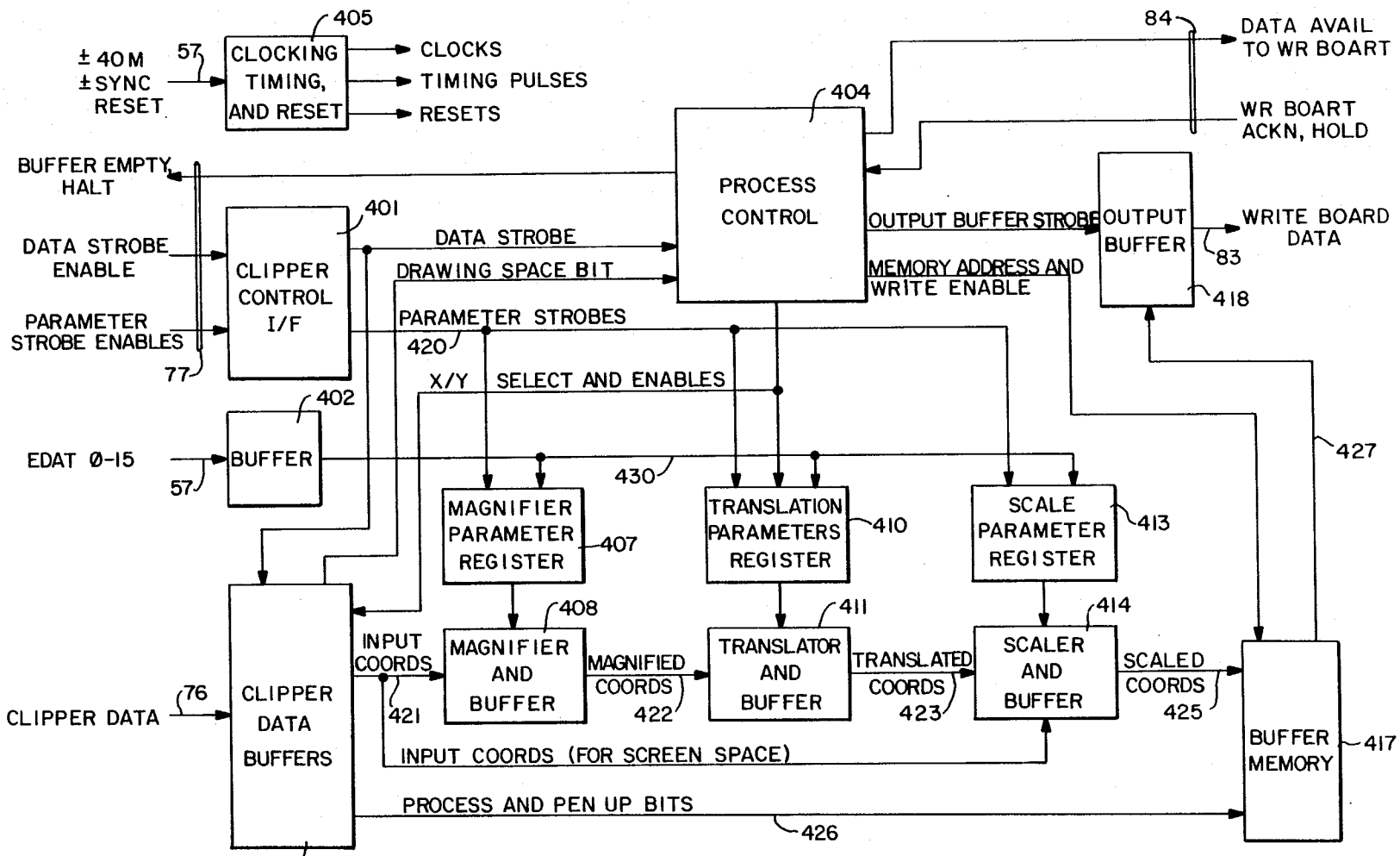
FIG. 34 depicts a block diagram of a scaler circuit, which forms a portion of FIG. 2.

Referring now to FIG. 34, the scaler circuit 71 of FIG. 2 is shown in more detail. The 40 MHz, SYNC and reset signals on bus 57 are input to clocking, timing and reset circuit 405, which provides appropriate timing pulses for the scaler circuit.

Clipper control interface circuit 401 receives data strobe enable and parameter strobe enable signals from the clipper on bus 77. Buffer 402 receives 16-bit system data signals on bus 57 for connection to magnifier parameter register 407, translation parameter register 410, and/or scale parameter register 413. Clipper data on bus 76 from the clipper circuit 70 are input to clipper data buffers 403.

During the set view operation, the scaler provides the functions of magnify, translate, scale and buffer. Parameters from the command processor 50 of FIG. 1 are loaded through buffer 402 into the registers 407, 410, 413 via bus 430. Data on bus 76 from the clipper are received and stored in the clipper data buffers 403.

Assuming a drawing space mode, the X and Y coordinates are sent in pipeline fashion (Y-coordinate following X-coordinate) through the magnifier 408, translator 411 and scaler 414 circuits, via bus 421–423, respectively.

In screen mode, the X and Y coordinates are loaded directly into scaler and buffer circuit 414 via bus 421 without processing. From buffer 414, in either mode, the scaler coordinates on bus 425, together with the process and pen up bits on bus 426, are loaded into buffer memory 417. From memory 417, data are sent via bus 427 to output buffer 418, a one-word or 25-bit output buffer, and to the write circuit 80 in FIG. 1 on bus 83.

Figure 35:
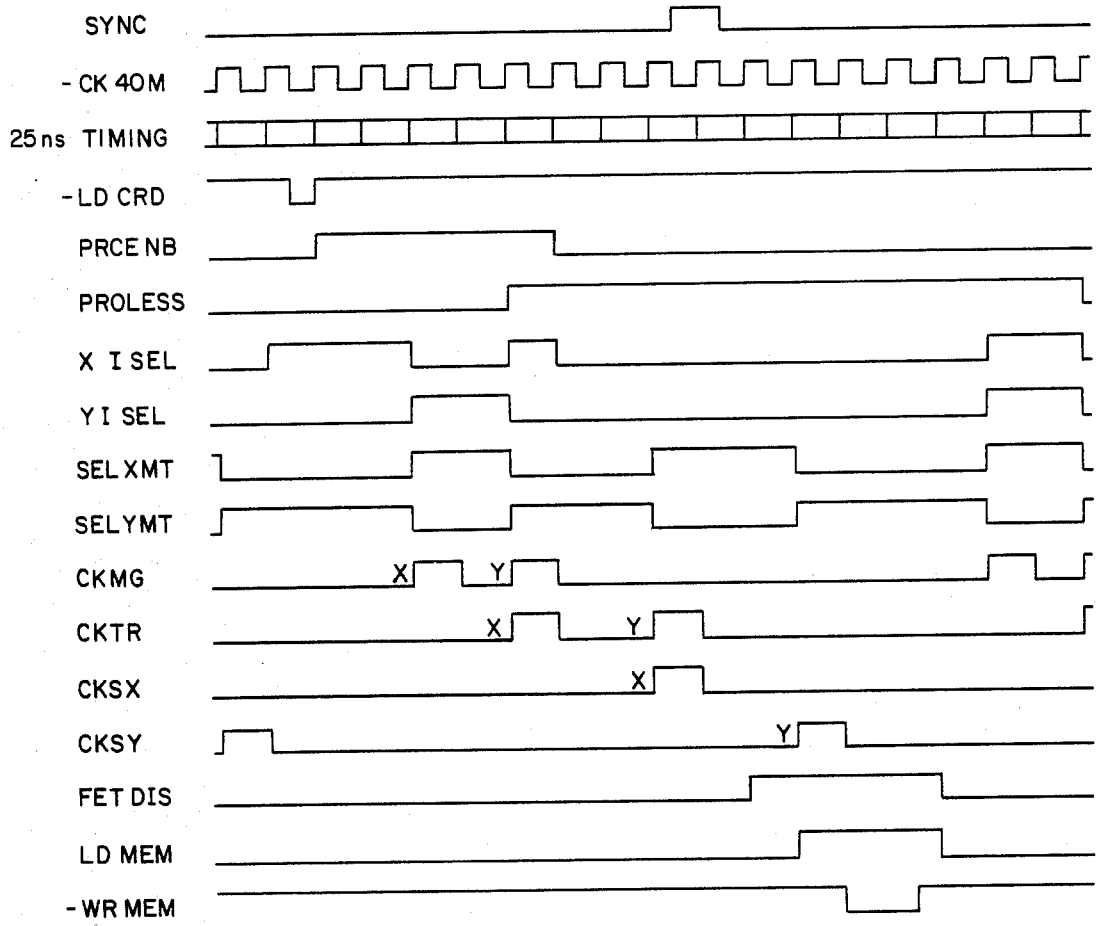
FIG. 35 depicts a timing diagram for the scaler circuit of FIG. 34.

The scaler circuit basic timing is depicted in FIG. 35. The LDCRD signal loads clipper data into clipper data buffers 403 and raises PRCENB, which in turn enables the PROCESS signal, which will lead to the processed coordinates being written into buffer memory 417.

XISEL and YISEL signals enable the loading of respective input coordinates onto a common bus 421 which feeds magnifier circuit 408 and also the buffers in the scaler circuit 414.

The SELXMT and SELYMT signals select the appropriate translation parameter to be fed to the translator circuit 411.

The CKMG signal clocks the magnifier buffer 408. The X and Y notations on the timing diagram in FIG. 35 indicate the coordinate clocked.

The CKTR signal clocks translator buffer 411. The X-coordinate will be clocked into translator buffer 411 at the same time the X-coordinate in the magnifier buffer 408 is being overwritten by the Y-coordinate.

The scaler buffer 414 has separate buffers for both X and Y coordinates, which are clocked by CKSX and CKSY signals, respectively. At the occurrence of these respective clocks, XISEL and YISEL in FIG. 35 are off. However, in screen space mode, XISEL and YISEL will be active as required at the times in order to load the input coordinates into the scaler buffer 414.

The FETDIS signal prevents data from being read from the buffer memory 417. The LDMEM signal selects the write pointer (as opposed to the read pointer) for memory 417. WRMEM is the strobe that actually writes memory 417.

In FIG. 34, the magnifier buffer 408 takes 16-bit input coordinate data on bus 421 and left-shifts the data 0 to 15 bits ignoring overflow, and filling with zeros. The result is truncated to 12 bits and stored in magnifier buffer 408. The extent of the left-shift is determined by the magnifier parameter from register 407, which has been loaded via bus 430 from buffer 402.

Translator buffer 411 takes the 12-bit coordinate data from magnifier buffer 408 via bus 422 and subtracts from it the appropriate 12-bit (X or Y) translation parameter, the most significant borrow being ignored, and the result is stored in the buffer 411.

The scaler buffer 414 takes the 12-bit coordinate from translator buffer 411 vis bus 423 and multiplies it by the 8-bit scale parameter from register 413. The most significant bit (MSB) of the 20-bit result is discarded (it should be a zero) and the remainder is rounded back to 9 bits. The result is stored in one 9-bit buffer for X and another for the Y coordinate.

The contents (18 bits) of the scaler buffer 414 along with six process bits and the pen up bit on bus 426 are written into 1K buffer memory 417. Process bits and pen up bit are loaded into an input register (not shown) simultaneously with the reception of the coordinates from the clipper. They are loaded by the CKSK and CKSY signals into an intermediate register (not shown) which feeds the memory.

Output buffer 418 holds one full data word (coordinates, process bits and pen up bit) in transit from the buffer memory 417 to the write circuit 80 of FIG. 1. Buffer 418 is loaded whenever it is empty and buffer memory 417 contains data and is not being written. When it is being loaded or already contains a word, a data available signal is sent to a write circuit data 80 via process control circuit 404 and bus 84. The write circuit 80 responds with a data acknowledge (ACKN) which permits refilling of output buffer 418.

The data transfer rate between the scaler circuit 71 and write circuit 80 can be six words per 300 ns if buffer memory 417 is not being written or four words per 300 ns if it is being written. The write circuit 80 can send a HOLD signal via bus 84 which will cause the scaler circuit 71 to suspend processing data and writing the buffer memory whenever the buffer memory is more than half full.

Prior to the execution of the set view operation, the scaler circuit receives four parameters, in three words, from command processor via bus 57. The parameters are:

| Name | Symbol | Range |
|---|---|---|
| SCALE (MULTIPLY) | f | $0 \leqq f \leqq 2^8 - 1$ |
| MAGNIFY (SHIFT) | e | $0 \leqq e \leqq 2^4 - 1$ |
| X TRANSLATION | XMT | $0 \leqq XMT \leqq 2^{12} - 1$ |
| Y TRANSLATION | YMT | $0 \leqq YMT \leqq 2^{12} - 1$ |

During execution of the set view operation, the scaler circuit receives from the clipper via bus 76 data containing the following:

| NAME | COMMENTS |
|---|---|
| DRAWING SPACE | Bit differentiating between screen space and drawing space. |
| PROCESS BITS | Six bits stored and passed on to the WRITE CIRCUIT without modification. |
| PEN UP | Bit specifying Pen Up. Stored and passed on to the WRITE CIRCUIT without modification. |
| COORDINATE-PAIR | Coordinate-pair to be operated upon. Symbols X and Y. Range 0 to $2^{16} - 1$. |

In the drawing space mode, the scaler circuit applies all four functions (magnify, translate, scale, and buffer) to the input coordinate pair. In screen space it applies only the buffer function.

For a magnify (shift) function, the two input coordinates are left-shifted a number of places specified by the parameter, with overflow discarded, and with zeros shifted in. The result is then truncated to 12 bits. Consequently the magnify coordinate for X (and analogously for Y) is:

$$XM = \frac{X \cdot 2^e}{16} \text{ truncated, modulo } 2^{12}.$$

For the translate function, from the 12-bit magnified (shifted) coordinates, XM and YM, are subtracted the corresponding translation parameters stored in register 410, also each 12 bits. The subtraction is carried out modulo $2^{12}$ in that borrow-outs are ignored. For the X-coordinate (and analogously for Y) $XT = XM - XMT$, modulo $2^{12}$.

For the scale (multiply) function, the 12-bit translated coordinates on bus 423 are each multiplied by the 8-bit parameter f from register 413. The MSB of the 20-bit result, which should be a zero, is discarded. The remaining 19 bits are then truncated to 9 bits. Hence for the X coordinate (and analogously for Y) on bus 425, the X value is $$XS = \frac{XT \cdot f}{2^{10}}, \text{ truncated, modulo } 2^9.$$

For the buffer function, the 9-bit scaled coordinates on bus 425 (in the case of drawing space) or of the 16-bit inputted coordinates truncated to 9-bits (in the case of screen space) are stored in 1K word buffer memory 417 along with the six process bits and the pen up bit on bus 426. A one-word output register 418 holds the data words in transit from the buffer memory to the write board.

The scaler circuit flags the clipper via bus 77 and control circuit 404 to suspend sending data when buffer memory 417 is full or if the write circuit acknowledges a hold signal on bus 84, when the buffer memory 417 is more than half full.

The scaler parameters loaded into registers 407, 410, and 413 are received from the command processor via bus 57 and buffer 402. Strobing of these parameters into the appropriate scaler registers 407, 410, 413 is under control of the clipper circuit via bus 77, control interface 401 and bus 420.

Write Circuit

Figure 36A:
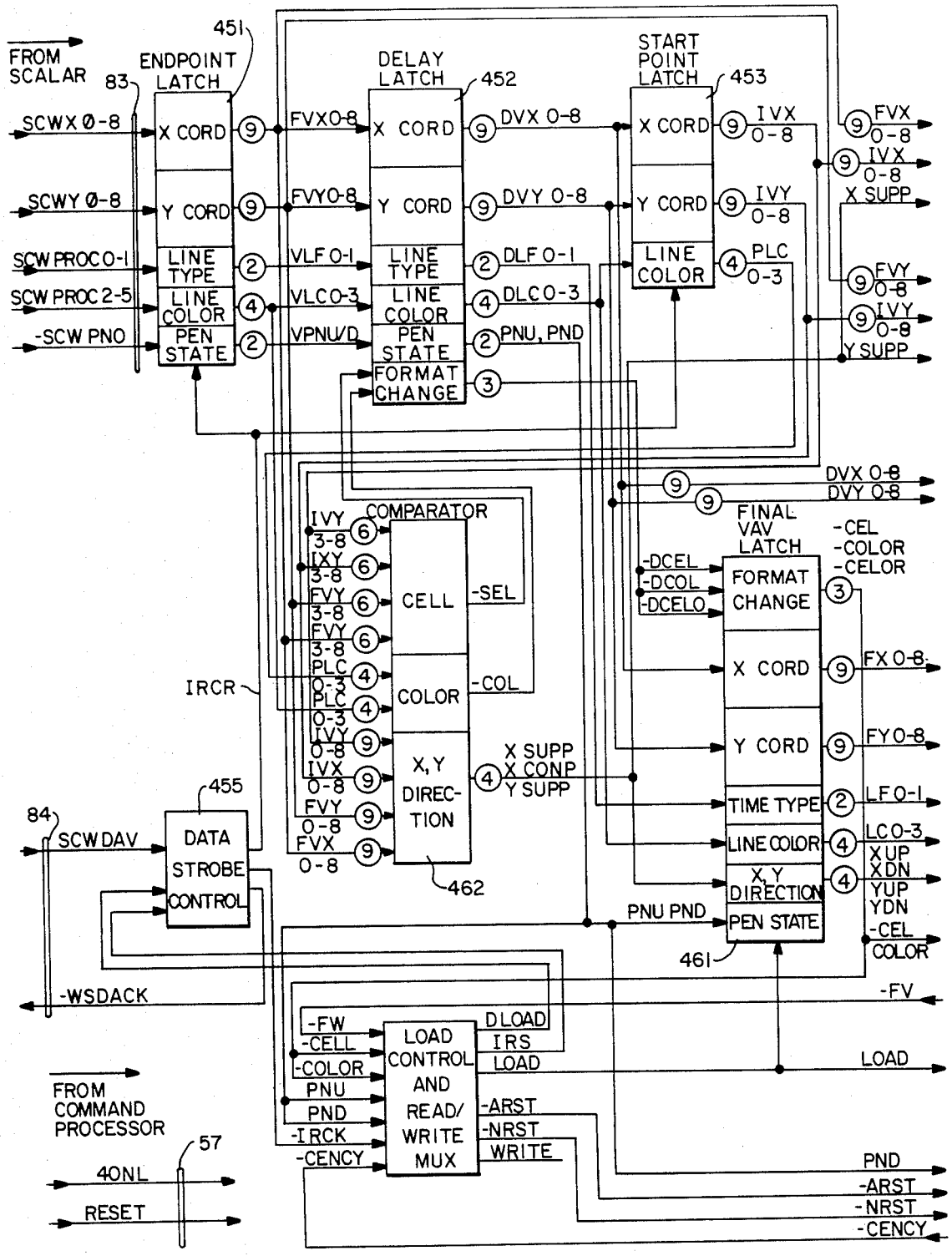
FIG. 36 depicts a block diagram of a write circuit, which forms a portion of FIG. 2.
Figure 36B:
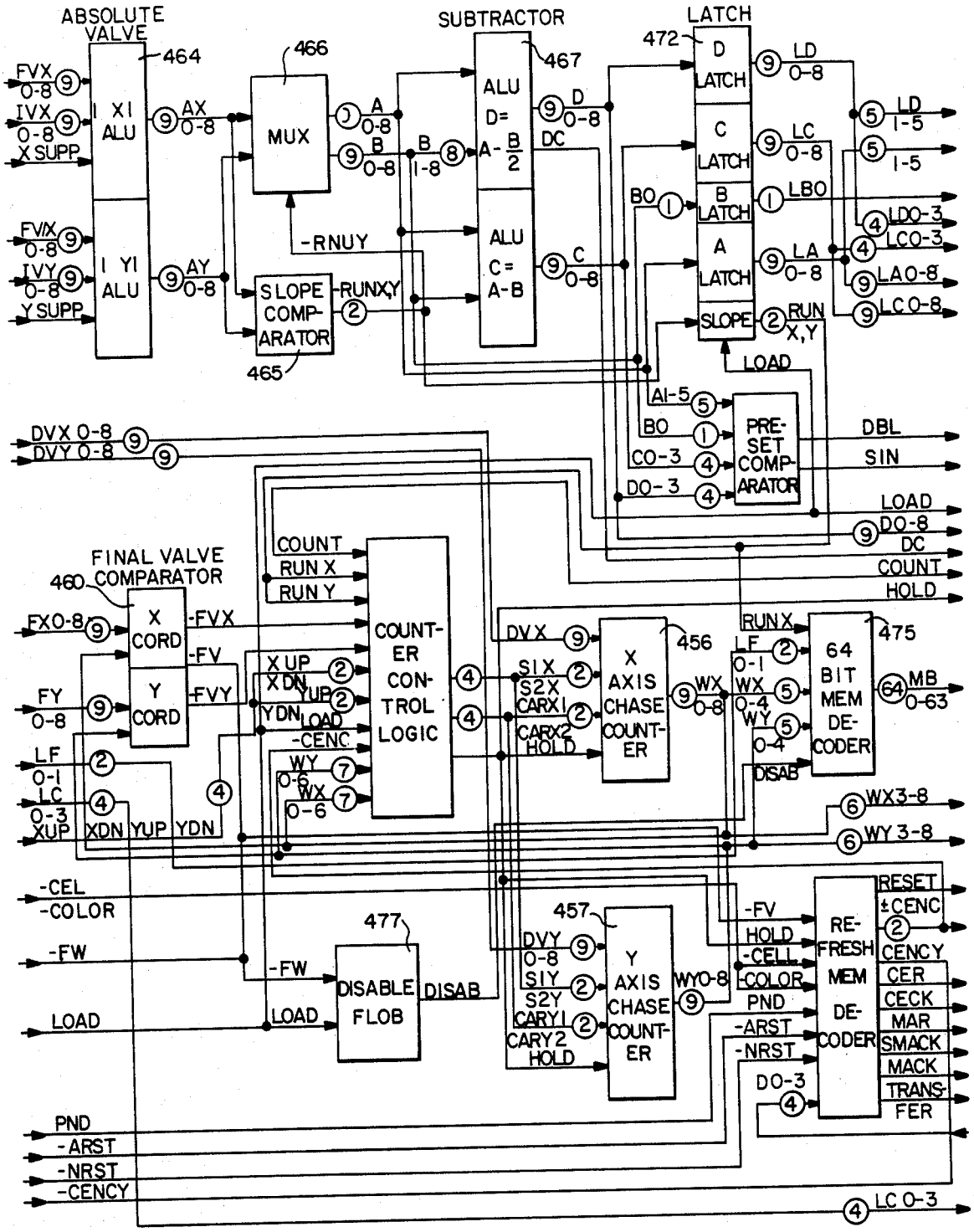
Figure 36C:
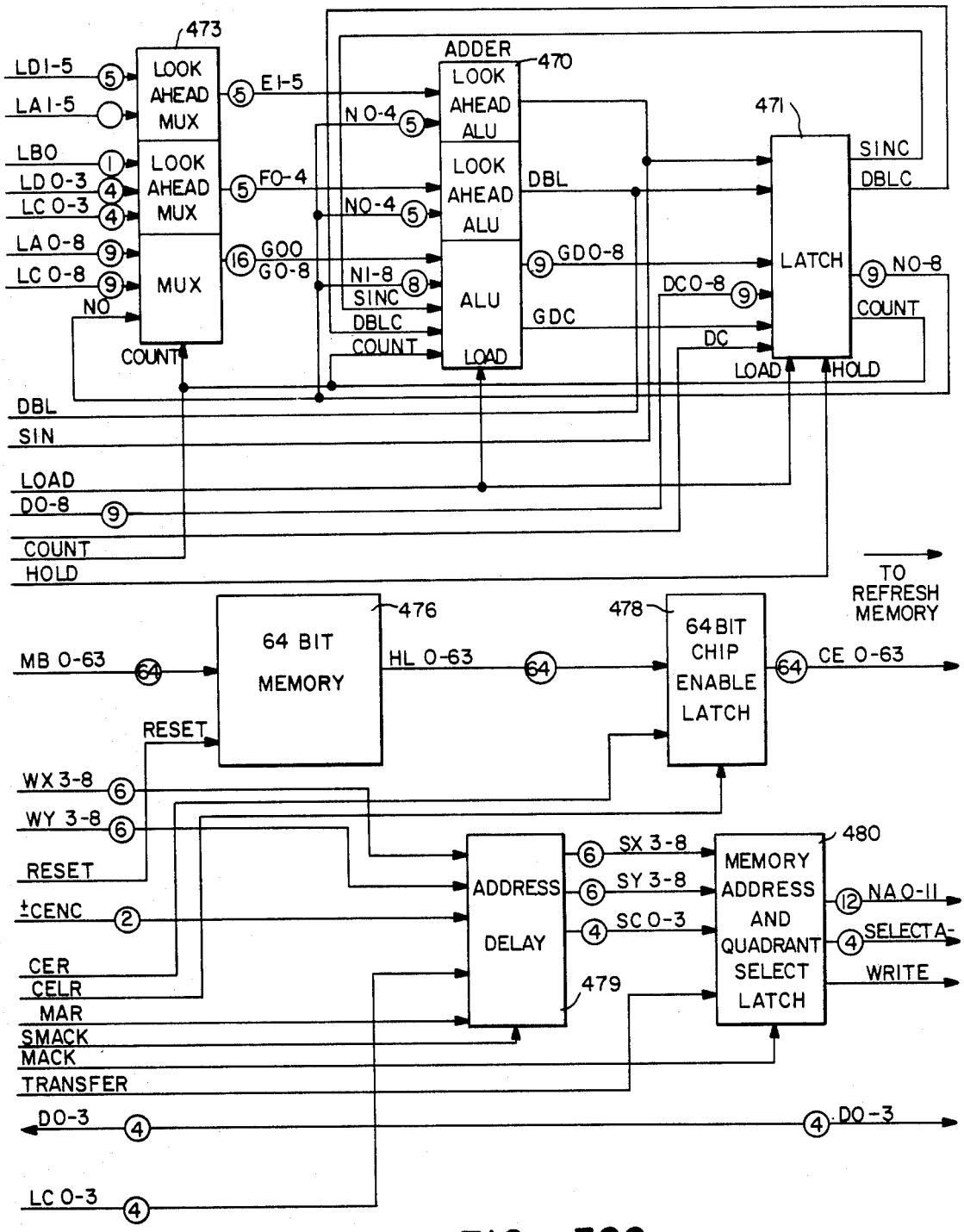

Referring now to FIG. 36, (FIGS. 36A, 36B, and 36C), the write circuit 80 of FIG. 2 is depicted in further detail.

The write circuit 80 performs the function of rapidly generating points in a matrix field to approximate the location of two-dimensional straight line vectors. The matrix field can be any rectangular matrix such as 512×512, 768×1024, 1024×1024 etc. A 512×512 matrix is assumed in the following description of the Write circuit. The points are subsequently transferred to refresh memory 81 which is used to refresh a standard television monitor scope. The refresh memory must have a storage capacity of at least equal to the number of points in the matrix field for a black and white display or some multiple of this size for a color display. The refresh memory referred to in this circuit description has a storage capacity of 262, 144 bits to accommodate the 512×512 matrix field for a black and white display.

Vector data stored in refresh memory 81 is derived from vector end points stored in a data base having considerably more resolution than the refresh memory which implies that vectors stored in the refresh memory are in general approximations of the vectors stored in the data base. The mapping of arbitrary vector end points from the data base to the refresh memory can be considered to be exact only for a relatively small number of vectors and magnification values. In a majority of cases, where arbitrary magnification and translation values are applied to a given vector, the end points being rounded to lesser precision will produce some distortion of geometrical figures, the effect being more noticeable as the number of points comprising the figure is reduced. The rounded vector end points are input to the write circuit from scaler circuit 71 along with the line format information (e.g., pen state, line type, and/or color). The write circuit then fills in the remaining points on the vectors and transfers them to refresh memory 71.

Data from scaler circuit 71 are transferred via bus 83 into an input register comprising an end point latch 451, delay latch 452 and start point latch 453.

Status information from the scaler circuit are input on bus 84 into data strobe control circuit 455. Data from command processor 50 of FIG. 1 are input via bus 57 providing the 40 MHz and reset signals previously described.

Vector data are transferred from the scaler circuit 71 to the write circuit 80 when the data available line (SCWDAV) on bus 84 is high, signifying that data are available on the data lines 83. Data are latched into the end point latch 451 by input register clock (IRCK) from data strobe control circuit 455. Data in the end point latch 451 are transferred to delay latch 452 during the next clock period.

The first vector data following a set view command will be a pen up vector and the coordinates of this vector are loaded from the delay latch 452 into X- and Y-axis chase counters 456, 457, as well as into final value latch 461 by the LOAD pulse. As soon as possible, another vector is transferred from the scaler circuit to end point latch 451 and the vector previously stored in this latch is transferred to start point latch 453. As soon as the previous vector has been processed by the chase counters, the next vector will be transferred from delay latch 452 to final value latch 461, in the case of a pen down vector, or to both final value latch 461 and the X and Y chase counters 456, 457, in the case of a pen up vector. Final value latch 461 can be loaded at the same time that the next vector is transferred to end point latch 451 provided that the input register already contains an unused vector and that the chase counters are not processing a vector. Subsequent scale circuit to write circuit transfers can occur simultaneously with a LOAD pulse or any time after the LOAD pulse has taken the previous vector. Subsequent LOAD pulses can occur whenever valid data exists in the input register provided that no other vector is being processed.

Final value latch 461 contains the end point coordinates of the vector being processed as well as the line type, line color, chase counter direction control lines along with signals that specify whether this vector has changed cell (to be explained), color, or both.

Final value comparator 460 separately monitors whether the state of the X and Y axis chase counters 456, 457 agree with the coordinates stored in the final value latch 461 so that the chase counters can be stopped when the end point is reached. Alternately, a counter could be loaded with the longer component of the vector being processed and this counter could then be counted down as the chase counters operate, ultimately reaching zero when the end point is reached. By monitoring the state of this counter, one could anticipate ahead of time when the last point in the vector will be reached. Write circuit 80 includes a diagonal generator which operates only on pen down lines. If an input vector has a pen down flag, then the coordinates in start point latch 453 and end point latch 451 are compared by the direction comparators 462 to determine whether the chase counters 456, 457 are to count up or down. After the proper direction has been determined, the absolute value of the vector component lengths along the X and Y axes are computed by ALU circuit 464. Slope comparator 465 determines whether the X or Y component is larger and controls multiplexer (MUX) 466, which selects the smaller (A) and larger (B) components. Subtractor 467 computes the value $C=A-B$ and $D=A-B/2$. The D value is used to preset the count latch 471 during a load cycle. The values of A, B, C and D are also loaded into latch 471 during a load cycle since they are needed later in the diagonalization process. The diagonal generator is not required when writing horizontal or vertical lines and can be bypassed if desired in order to eliminate the time required to calculate the A, B, C and D values.

Multiplexer (MUX) 473 selects either A or $C=A-B$ and the selected value is added to the data output of count latch 471 on the next accumulation cycle. If the count output of count latch 471 is low, then A is added to the data output of count latch 417 on the next cycle whereas if count is high then $A-B$ is added on the next cycle.

Because count latch 471 is required to accumulate at a fast clock rate, 40 MHz in the circuit being described, insufficient time is available to use the carry output from the LSB adder of adder 470 to provide the carry input to the MSB adder of adder 470. Hence a look ahead circuit consisting of two 4-bit adders 470 (SIN, DBL) and two multiplexers (MUX) 473 calculate the results of four possible combinations of two successive operations and the results are stored in count latch 471 and the appropriate one is selected by the count output on the next cycle and routed to the carry input of the MSB adder. The count output of the count latch will be high if the adder had a carry out (GDC) on the previous clock cycle. A high level on the count output will eventually be used to enable one of the chase counters 456, 457 and since count will generally be low for some fraction of the active clock cycles, one of the chase counters 456, 457 will count less frequently than the other. Since B represents the length of the longer component of the vector and A the length of the shorter component, one of the chase counters 456, 457 will count B times and the other will count A times. The result of any operation will be greater than or equal to $A-B$ and less than A which leads to the inequality $$A-B \leqq B \cdot A - A \cdot B + I < A$$

where I is the initial value in the count latch. This equation can be rewritten as $$B \geqq I - A > \emptyset$$

which makes it clear that there are in general a number of choices for I that will lead to the corrent vector end point. However, the path taken to reach this end point is influenced by the choice of I. The path which most closely approximates the desired line will result when I is chosen to be approximately the arithmetic average of A and $A-B$, so that $I=A-B/2$ is a good choice. Since D has been previously defined as $D=A-B/2$, then $I=D$.

Counters 456, 457 initially contain the beginning point of a vector as a result of either being preset to this state by a pen up operation or by being counted to this state as a result of processing a previous pen down vector. When the next pen down vector is loaded into final value latch 461, one or both of the counters 456, 457 will operate until the state of the counters match that stored in final value latch 460. The counter whose vector component is larger will be programmed by the slope comparator 465 to count continuously except when restrained from doing so by refresh memory cycle time limitations. The other counter is also subject to this cycle time restriction and in addition can only operate when count is high.

The three least significant bits of both counters 456, 457 are decoded by one out of 64 decoder 475 to determine the location of the appropriate point in an 8×8 matrix (the matrix defining a cell) and this data point is stored in 64-bit memory 476, which is a one's latching memory so that data points can be accumulated without regard to previous data.

Decoder 475 is enabled by signal INHIB, from inhibit flip flop 477, going low when a vector is loaded into final value latch 461. Decoder 475 is disabled by signal INHIB going high after the end point is reached. This prevents extraneous data from being written into memory 476 after the contents of this memory have been transferred to chip enable latch 478.

Memory 476 will accumulate a new data point every clock cycle as successive vectors are processed until it becomes imminent that one or both of counters 456, 457 crosses a cell boundary on the next clock cycle or a color change occurs or until the input register empties. If any of these possibilities occurs the contents of memory 476 are transferred to chip enable latch 478, the cell address, which is derived from the high order bits of the counters 456, 457, is transferred from an address delay latch 479 to memory address latch 480 and the color bits are also transferred from address delay latch 479 to color select latch 480. These three latches constitute an output latch and the data must be maintained valid in these latches until the cycle time of refresh memory circuit 81 has been satisfied. The transfer of data to the output latches is therefore subject to the condition that the previous memory cycle has timed out. More than eight points can be transferred at one time if one or more corners of the polygon are contained in a cell. However, the statistical probability of this occurring diminishes rapidly as the number of points increases above eight.

Simultaneously with data transfer to the output latch, a WRITE pulse is output to refresh memory circuit 81 which initiates a new refresh memory cycle and a reset pulse is generated which causes memory 476 to be erased during the next clock interval. If chase counter decoder 475 is enabled when the reset pulse occurs, then the selected bit will remain set if it was previously set or it will be set during the next clock interval if it was not previously set since decoder 475 overrides the reset command.

The memory organization of this system 15 is based upon, but not limited to, an 8×8 matrix format which permits horizontal, vertical and diagonal lines to be transferred to refresh memory circuit 81 at the rate of 8 points every 200 ns when using a 40 MHz clock. The system utilizes a refresh memory having 4096 words of data storage, each word containing 64 bits to accommodate the 8×8 cell. Except for the first and last cells, a refresh memory that will cycle in 200 ns or less will suffice, however, the first and last cell may contain fewer than 8 points which means that even a 50 ns refresh memory might be slower than desired for this situation. The first and last cells will be processed more rapidly on the average as faster refresh memories are made available. A fast memory becomes more important as the proportion of short vectors or pen up vectors increases.

In order to generate the intermediate points of a diagonal vector, given the end points, previous techniques have used binary rate multipliers or differential digital analyzers, which tend to waste clock cycles and generate dense lines, consuming time.

The present system utilizes a technique which permits diagonal lines to be generated at the rate of one point each clock cycle provided that the previous memory cycle times out before a cell boundary is crossed, thereby generating a minimal density line which allows diagonal lines to be written as rapidly as the longer component could be written if it were written by itself (assuming of course that no time was lost waiting for the refresh memory cycle to time out) and thereby no wasted clock cycles.

A fast memory is quite desirable when writing diagonal lines since a large fraction of the intersected cells can contain fewer than eight points. For instance, it is possible to construct situations where slightly more than half of the intersected cells contain only a single point. To facilitate the utilization of faster refresh memory devices, as they become available, the present write circuit is designed with a memory cycle time controller that is automatically programmed by refresh memory circuit 81 to accommodate cycle times between 50 and 200 ns, in increments of 25 ns.

In summary, then, the write circuit can generate a new point on any vector every clock cycle, subject to refresh memory cycle time limitations and can accommodate refresh memories having cycle times between 50 and 200 ns.

Read Circuit

Figure 37:
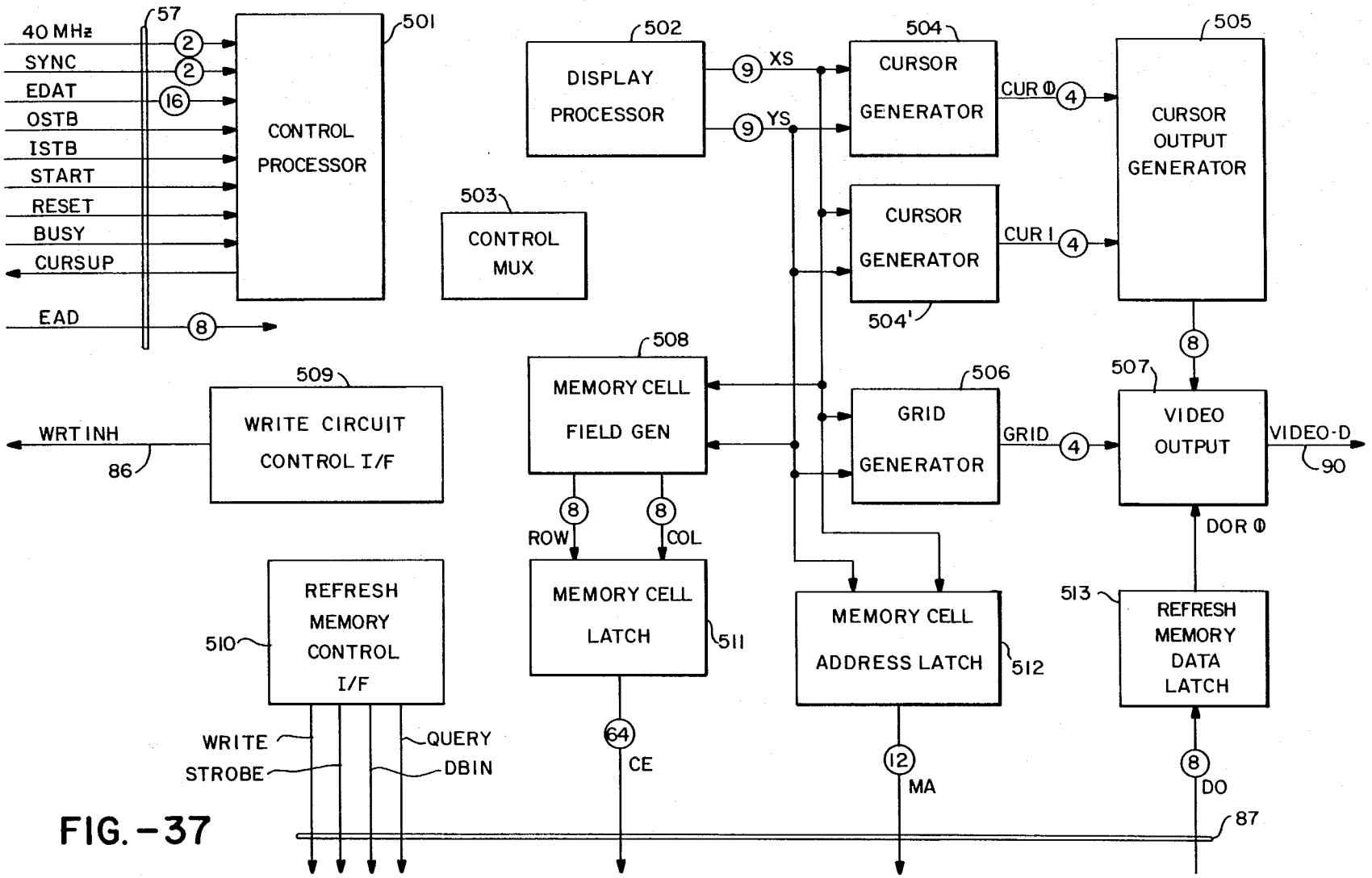
FIG. 37 depicts a block diagram of a read circuit, which forms a portion of FIG. 2.

FIG. 37 depicts in more detail the read circuit 82 of FIG. 2. Read circuit 82 performs the function of generating the intensity and synchronization signals necessary to display a graphic image on a raster-scan CRT monitor such as monitor 20 of FIG. 1. The image includes a primary image, obtained from the refresh memory circuit 81 of FIG. 2, upon which are superimposed a grid and two cursors. Other functions of the read circuit 82 include selectively erasing the refresh memory 81, transmitting the contents of the refresh memory 81 to the command processor 50, controlling the activity of the write circuit 80, and interpreting the commands issued by the command processor 50 via bus 57.

Referring now to FIG. 37, the read circuit 82 includes a control processor 501, which receives control and data signals via bus 57 from the command processor 50 of FIG. 2, interprets these signals as commands and timing information, and generates various control signals (not shown) necessary to execute the commands intended for read circuit 82. Read circuit 82 responds to the commands set forth in Table III issued by command processor 50:

TABLE III

| | |
|---|---|
| SET CURSOR | LOAD PROGRAM |
| SET GRID | EXAMINE PROGRAM |
| SET ERASE | LOAD CURSOR TABLE |
| READ REFRESH MEMORY | LOAD VIDEO TABLE |
| QUERY REFRESH MEMORY | LOAD REGISTER |
| READ STOP | EXAMINE STATUS |
| READ GO | |

In one embodiment, control processor 501 is a microprogrammed processor having a 40-bit microword and a cycle time of 50 ns. The microprogram is PROM-resident. Following a general system reset, execution of the microprogram begins at address zero.

Read circuit 82 also includes a display processor 502, which generates various control signals (not shown) under the supervision of the control processor 501. These signals control the operation of the memory cell field generator 508, write circuit control interface 509, refresh memory control interface 510, memory cell bit latch 511, memory cell address latch 512, and refresh memory data latch 513. Display processor 502 is used by control processor 501 to cooperate in executing certain commands as they are being received. The display processor may also function independently, as it does, for example, in controlling the generation of the video image on CRT monitor 20.

Display processor 502 also generates signals XS and YS, which designate the x-y coordinates of a pixel of the graphics image.

In one embodiment, display processor 501 is a microprogrammed processor having a 60-bit microword and a cycle time of 25 ns. The microprogram is RAM-resident. Command processor 50 issues a LOAD PROGRAM command to load the display processor microprogram memory and, optionally, to initiate execution of the microprogram at a specified address. An EXAMINE PROGRAM command may be issued to read back the contents of a specified word of the microprogram memory, for diagnostic purposes. Display processor 502 also includes counter registers for generating the XS and YS signals and three additional counter registers, included for timing and iteration control purposes.

Display processor operation may be halted by issuing the READ STOP command and may be resumed by issuing the READ GO command.

Read circuit 82 also includes control multiplexer 503, which allows control processor 501 to generate certain control signals normally generated by the display processor.

Cursor generators 504 output pixel data pertaining to the two cursors generated by read circuit 82. For each pixel of a given cursor, two bits are output which correspond to its column location XS and two bits are output which correspond to its row location YS. Cursor pixel information is stored in cursor generator 504 in the form of two 512×2-bit edge arrays, one indexed by XS and one indexed by YS. These edge arrays are loaded via bus 57 by command processor 50, using the SET CURSOR command.

Similarly, grid generator 506 outputs pixel data pertaining to the grid generated by read circuit 82. For each pixel of the grid, two bits are output which correspond to its column location XS and two bits are output which correspond to its row location YS. Grid pixel information is stored in grid generator 506 in the form of two 512×2-bit edge arrays. These edge arrays are loaded via bus 57 by command processor 50, using the SET GRID command.

Cursor output generator 505 combines the pixel data pertaining to the two cursors into a three-bit value, according to an arbitrary Boolean function implemented as a 256-word look-up table. This look-up table is loaded via bus 57 by command processor 50, using the LOAD CURSOR TABLE command.

Similarly, video output generator 507 combines the pixel data pertaining to the grid with pixel data from the refresh memory 81 and cursor summary data from cursor output generator 505. An eight-bit result is generated internally, according to an arbitrary Boolean function implemented as a 256-word look-up table. This look-up table is loaded via bus 57 by command processor 50, using LOAD VIDEO TABLE command. The four-bit result represents the brightness of the pixel to be produced in the graphics image. A digital-to-analog converter circuit within video output generator 507 converts the four-bit digital result to the electrical voltage required to produce the desired pixel brightness on CRT monitor 20 via bus 90. The digital-to-analog converter also generates the electrical voltages required to effect synchronization of CRT monitor's X and Y raster sweep function with the presented video image.

Memory cell field generator 508, refresh memory control interface 510, memory cell bit latch 511, memory cell address latch 512, refresh memory data latch 513, and bus 87 constitute the interface of read circuit 82 with refresh memory 81.

Memory cell field generator 508 specifies which rows and columns within an 8×8 memory cell participate in the current memory read or write operation. Any single column, pairs of columns on a two-column boundary, the left or right four columns, or all eight columns may be specified, and similarly for rows. For a read operation it is typical to specify a single row and all eight columns.

Memory cell field generator 508 may be used to specify which rows and column of an 8×8 cell to erase to a specified background condition. Information is stored in memory cell field generator 508 specifying which rows and columns of the graphics image are to be erased. Erase information is stored in two 512×1-bit edge arrays, similar in concept to the edge arrays in cursor generator 504 and grid generator 506. Memory cell field generator 508 may optionally output the Boolean conjunction of the erase information for a memory cell's rows/columns and the directly specified rows/columns. For an erase write operation it is typical to specify a single row and all eight columns directly, and to specify the Boolean conjunction with erase edge array data in both X and Y directions. The erase edge arrays are loaded via bus 57 by command processor 50, using the SET ERASE command.

Memory cell bit latch 511 generates signals specifying which individual bits of an 8×8 memory cell participate in the current refresh memory read or write operation, from the specification by rows and columns generated by memory cell field generator 508. A latching function is also performed.

Memory cell address latch 512 latches the upper six bits of the XS and YS signals, which constitute a specification of the particular 8×8 memory cell affected by the current refresh memory operation.

Refresh memory data latch 513 receives data corresponding to the columns of an 8×8 memory cell during a read operation. It outputs this data serially to video output generator 507 during the process of generating a graphics image on CRT monitor 20. Alternatively, during the READ RASTER MEMORY command, received data is transferred in parallel on an internal bus (not shown) to control processor 501, which in turn transmits the data via bus 57 to command processor 50. Data obtained in this way can be used for diagnostic purposes and can also be processed further for output to a dot matrix hard copy peripheral. Data received during the QUERY RASTER MEMORY command is treated in the same way. However, the data itself, generated in the refresh memory circuit 81 without regard to the other signals whenever QUERY signal is asserted, is a code specifying the minimum cycle time of refresh memory 81. The data obtained in this way can be used to select a display algorithm that optimizes use of refresh memory.

Refresh memory control interface 510 determines what kind of refresh memory operation is being performed. The QUERY signal is asserted during a query raster memory operation. The STROBE signal is asserted during a read operation. The WRITE signal is asserted during a write operation, in which case the DBIN signal determines the data value written to selected bits of the selected 8×8 memory cell. The QUERY, STROBE, and WRITE signals are driven directly from display processor 502, while the DBIN signal is latched separately and can be set and reset by display processor 502.

Write circuit control interface 509 generates the WRTINH signal, which when asserted prevents write circuit 80 from accessing refresh memory 81. The state of the WRTINH signal can be set and reset by display processor 502. Whenever the WRTINH signal is unasserted, read circuit 82 must unassert the CE, MA, QUERY, WRITE, and STROBE signals, to avoid conflicts with their use by write circuit 80, and must provide the correct DBIN signal, namely the complement of the background value.

The LOAD REGISTER and EXAMINE STATUS commands are included in read circuit 82 for diagnostic and test purposes. Various internal registers may be set to known values and/or examined using these commands.

Proper operation of read circuit 82 requires the initialization of its internal state. When command processor 50 asserts the RESET signal of bus 57, control processor 501 suspends execution of its microprogram. When the reset signal is unasserted, control processor 501 resumes execution at address zero, placing it in a correct microprogram sequence for receiving and interpreting commands, while suspending execution of the display processor 502 microprogram.

Next, command processor 50 issues LOAD CURSOR TABLE commands, to initialize the look-up table within cursor output generator 505, and LOAD VIDEO TABLE commands, to initialize the look-up table within video output generator 507. These tables define the rules whereby edge array specifications of the grid and cursors are merged with primary image data to form the video output signal on bus 90 to CRT monitor 20.

This look-up table mechanism allows the brightness of the cursors, grid, primary image, and their combinations to be specified arbitrarily. It also affords considerable flexibility in specifying how row and column edge array data is combined to form shapes. For example, the grid may be displayed either as a rectangular matrix of points or as lines that pass through those points.

Command processor 50 also issues LOAD PROGRAM commands, to download the microprogram memory of display processor 502. Then, command processor 50 issues SET ERASE commands, to establish erase edge array data for clearing refresh memory; SET CURSOR commands, to clear the cursor edge arrays; and a SET GRID command, to clear the grid edge arrays. Finally, command processor 50 initiates execution of the display processor microprogram, causing display processor 502 to erase refresh memory 81 and display a blank graphics image on CRT monitor 20.

The initialization sequence described above is normally performed only when graphics display system 15 is issued a reset command by CPU 50.

During normal execution of the microprogram for generating a graphics image, display processor 502 asserts the CURSUP signal of bus 57 at the end of each video frame. This signal interrupts command processor 50 and allows it to issue certain commands, such as SET CURSOR, SET GRID, and SET ERASE, during the time between video frames, thus avoiding a disruption in the presentation of video frames. Also during normal execution of this microprogram, display processor asserts the WRTINH signal of bus 86 continuously, so that read circuit 82 has unlimited access to refresh memory 81 and write circuit 80 is denied access.

Command processor 50 issues a SET CURSOR command between video frames as described above. Command processor 50 is responsible for generating the edge array data transmitted within the SET CURSOR command via bus 57 to read circuit 82, given the parametric specification in the corresponding SET CURSOR command transmitted from host CPU 10 via bus 56 to command processor 50, as shown in FIG. 12.

Similarly, command processor 50 issues a SET GRID command between video frames. Command processor 50 is responsible for generating the edge array data transmitted within the SET GRID command via bus 57 to read circuit 82. The edge array representation allows grids to be specified with considerable flexibility. For example, the spacing in X and can be different and even non-uniform.

Read circuit 82 does not respond to a SET VIEW command as such, but does respond to a SET ERASE command issued by command processor 50 between video frames during a set view operation. Command processor first issues a SET VIEW command and at a later time, but before the completion of the set view operation, issues a SET ERASE command. Command processor 50 is responsible for generating the edge array data transmitted within the SET ERASE command via bus 57 to read circuit 82, given the viewport specifications in the corresponding SET VIEW command received by command processor 50 from host CPU 10 via bus 56. In addition to loading the erase edge array data, read circuit 82 sets an internal flag, indicating that during the presentation of the next video frame the specified viewport is to be erased.

During the same inter-frame interval that command processor 50 issues a SET ERASE command, it also issues a LOAD PROGRAM command, which causes display processor 502 to set the DBIN signal to the proper background state, as specified by the SET VIEW command received from host CPU 10.

During the subsequent video frame, read circuit 82 erases the specified viewport to the specified background state. At the end of the frame, read circuit 82 clears the internal flag that caused the erase to occur, complements the DBIN signal, relinquishes the rest of bus 87, and unasserts the WRTINH signal on bus 86, thus permitting write circuit 80 to write new data to refresh memory 81. Then read circuit 82 monitors the BUSY signal of bus 57 and thereby waits for the set view operation to complete. If the inter-frame interval expires before the set view operation completes, read circuit 82 generates one or more blank video frames while waiting, rather than interrupt write circuit 80 or alter the timing of video frame presentation. When set view operation completes, read circuit 82 reasserts the WRTINH signal and resumes its task of generating a graphics image on CRT monitor 20.

Refresh Memory

Figure 38:
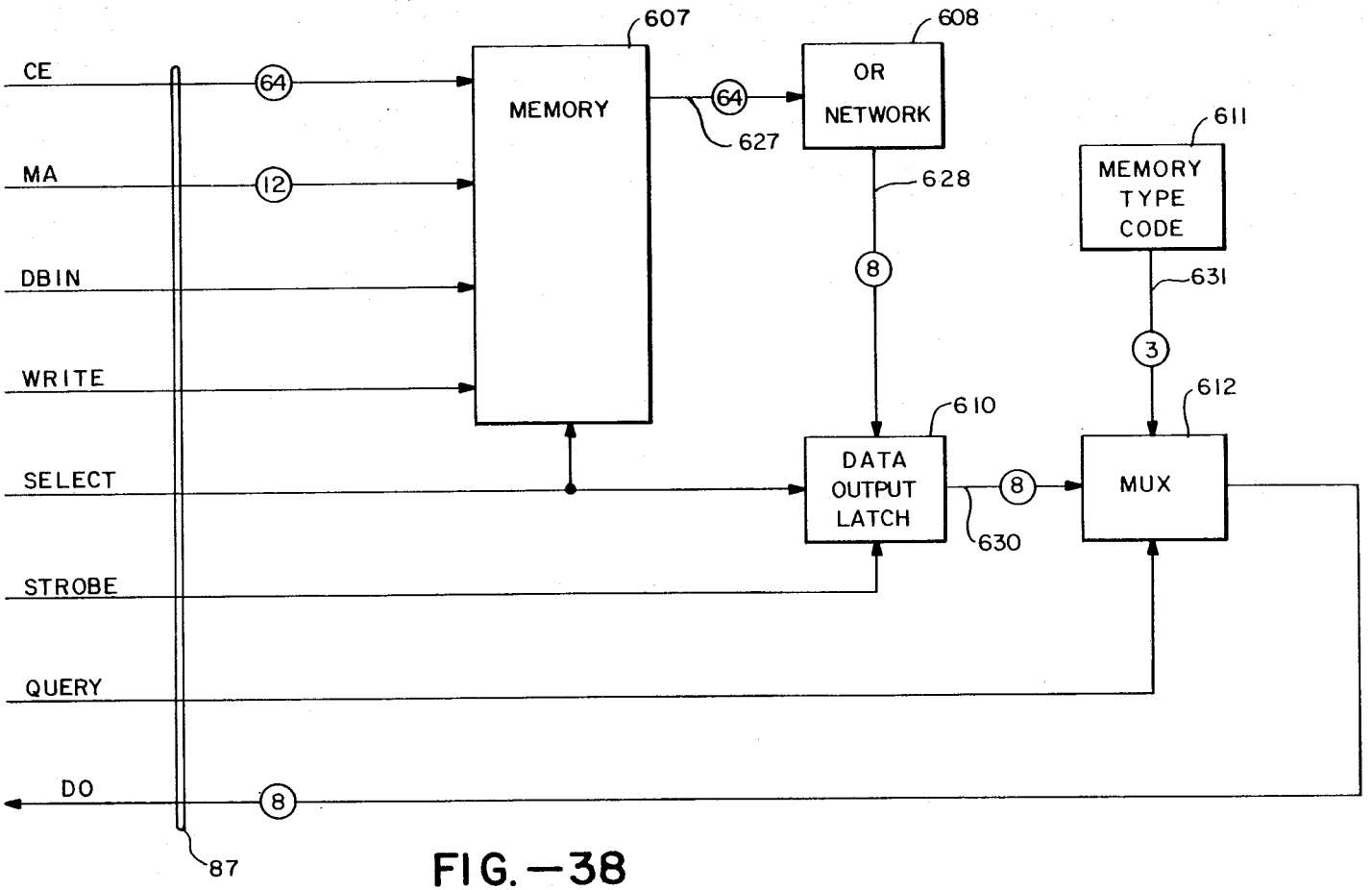
FIG. 38 depicts a block diagram of a refresh memory, which forms a portion of FIG. 2.

FIG. 38 depicts in more detail the refresh memory circuit 81 of FIG. 2. Refresh memory circuit 81 is used by system 15 to store raster data generated by write circuit 80 and to make this raster data available to read circuit 82 for display and other purposes. Data can also be stored into refresh memory circuit 81 by read circuit 82, typically for the purpose of erasing refresh memory circuit 81. Refresh memory circuit 81 can also be requested by write circuit 80 or read circuit 82 to output a code describing the speed of refresh memory circuit 81, so that write circuit 80 and read circuit 82 can access refresh memory circuit 81 as rapidly as possible.

Referring now to FIG. 28, refresh memory circuit 81 includes a memory 607 into which raster data is stored. In one embodiment, memory 607 comprises sixty-four 4096-bit memory integrated circuits. Memory 607 includes logic circuits (not shown) to interface the signals of bus 87. The logic circuits are incidental to the conceptual operation of refresh memory circuit 81 and need not be described in detail.

Each memory integrated circuit within memory 607 has twelve address signals, one chip-enable signal, one write signal, one data-in signal and one data-out signal. The memory circuits are interconnected so that the address signals, data-in signals and write signals of the circuits are connected to logically equivalent copies of the MA, DBIN and WRITE signals of bus 87, respectively. However, the chip enable signal of each circuit is connected logically to its own unique CE signal on bus 87.

Memory 607 is thus organized as 4096 64-bit words, with the MA signals of bus 87 specifying which word is accessed. Moreover, since all memory integrated circuits within memory 607 are logically connected to a common WRITE signal on bus 87, a given word as a whole may be accessed for reading or accessed for writing, but may not be accessed so that part of the word is accessed for reading and another part of the word is simultaneously accessed for writing. Furthermore, since all memory integrated circuits within memory 607 are logically connected to a common data-in signal, DBIN on bus 87, a given word as a whole may be accessed for writing ones or accessed for writing zeroes, but may not be accessed for writing ones into part of the word and zeroes into another part of the word simultaneously.

However, since each memory integrated circuit within memory 607 is logically connected to its own unique chip enable signal within the CE portion of bus 87, the effect of a memory access on the accessed word may be controlled for each bit within the word independently. Specifically, for a write access, the CE signals specify which bits within the accessed word (i.e., circuits within memory 607) are to be loaded with the value specified by the DBIN signal and which bits are to remain unchanged. Similarly, for a read access, the CE signals specify which circuits within memory 607 are to output data on their respective data-out signal lines and which circuits are to force their respective data-out signal lines to a high-impedance, inactive state.

Refresh memory circuit 81 further includes OR network 608 for reducing the size of the data-out bus 627 of memory 607. Each signal of bus 628 is generated as the inclusive OR function of eight signals of bus 627. By appropriately asserting the CE signals in groups of eight, it is possible to read out the 64 bits of a given word within memory 607, eight bits at a time, in eight sequential read operations. Given the interpretation that the 64 bits within a word represent an $8\times8$ array of picture elements, the OR network 608 is so structured that each output of bus 628 represents the inclusive-OR of signals corresponding to a column of picture elements within the $8\times8$ array. It is therefore possible to read out the picture elements of a row within the $8\times8$ array simultaneously.

Refresh memory circuit 81 further includes data output latch 610 for synchronizing data output. The STROBE signal of bus 87, when asserted, causes the internal state of output data latch 610 to follow continuously the contents of bus 28, and, when unasserted, causes output data latch 610 to store the contents of bus 628 internally.

The SELECT signal of bus 87, when unasserted, causes output data latch 610 to unassert bus 630, so that no data can be output. It also causes memory 607 to ignore the WRITE signal of bus 87, so that no data can be input. However, when SELECT is asserted, output data latch 610 asserts its internal state on bus 630 and memory 607 responds normally to the WRITE signal.

Refresh memory circuit 81 further includes memory type code circuit 611 for encoding a description of the performance characteristics of refresh memory circuit 81 and multiplexer 612 to allow this information to be accessed internally. Memory type code circuit outputs on bus 631 a three-bit integer, between 1 and 7, which is one fewer than the number of 25 us clock periods required by the memory to complete a read or write cycle. If the QUERY signal of bus 87 is asserted, multiplexer 612 routes the code on bus 61 to the three low-order signals of the DO portion of bus 87, but if QUERY is unasserted, multiplexer 612 routes the contents of bus 630 to the DO portion of bus 87.

Refresh memory circuit 81 has four features which particularly suit it for use in graphics display system 15. The first feature is that write circuit 80 can write multiple raster points into refresh memory circuit 81 within each memory write cycle. This feature is of value because, typically, write circuit 80 is able to generate raster points much faster than refresh memory circuit 81 can perform a memory write operation. For example, in one embodiment, write circuit generates raster points at a rate of one point every 25 ns, but a memory write operation is performed in 175 ns. By writing multiple raster points per memory cycle, it is possible in many cases for write circuit 80 to generate raster points at the maximum rate, without having to wait for refresh memory circuit 81.

The second feature is that the organization of refresh memory circuit 81, into 64-bit words in one embodiment, is compatible with the interpretation imposed by write circuit 80 and read circuit 82 that the bits within a word represent picture elements within a rectangular portion, or cell, of the rasterized graphics image. In the case of a 64-bit word, the following interpretations regarding cell shape are possible: $64\times1$, $32\times2$, $16\times4$, $8\times8$, $4\times16$, $2\times32$, and $1\times64$. In one embodiment, an $8\times8$ cell shape is used to facilitate equally the rasterizing of both horizontal and vertical lines.

The third feature is that the width of the data path out of refresh memory circuit 81, the DO portion of bus 87, can be designed to be any divisor of the word size, by utilizing the technique of ORing (or wire-ORing) the data outputs of multiple memory devices. The geometric interpretation of the bits which are accessed on the data out bus at one time, as is the case for the memory cell as a whole, is provided by read circuit 82 and write circuit 80. In one embodiment, the DO portion of bus 87 is eight bits in width and outputs one row of an $8\times8$ cell at a time. This provides a good match between the cycle time of refresh memory circuit 81, typically 175 ns, and the raster output scan rate, typically 25 ns per picture element.

The fourth feature is that, as write circuit 80 performs successive write operations to a given cell, using the same DBIN value in all cases to represent a raster point, refresh memory circuit 81 inherently accumulates these raster points. This is a consequence of the fact that on any given memory write cycle, the memory devices that are selected are written to the raster point value, while the memory devices that are not selected retain their previously established contents. Thus refresh memory circuit 81 functions as a ones-latching memory or zeroes-latching memory, depending on the state of the DBIN signal on bus 87. As a result, refresh memory circuit 81 can be updated by write circuit 80 using normal write cycles, rather than read-modify-write cycles, which minimizes the time required to update the memory.

Figure 39:
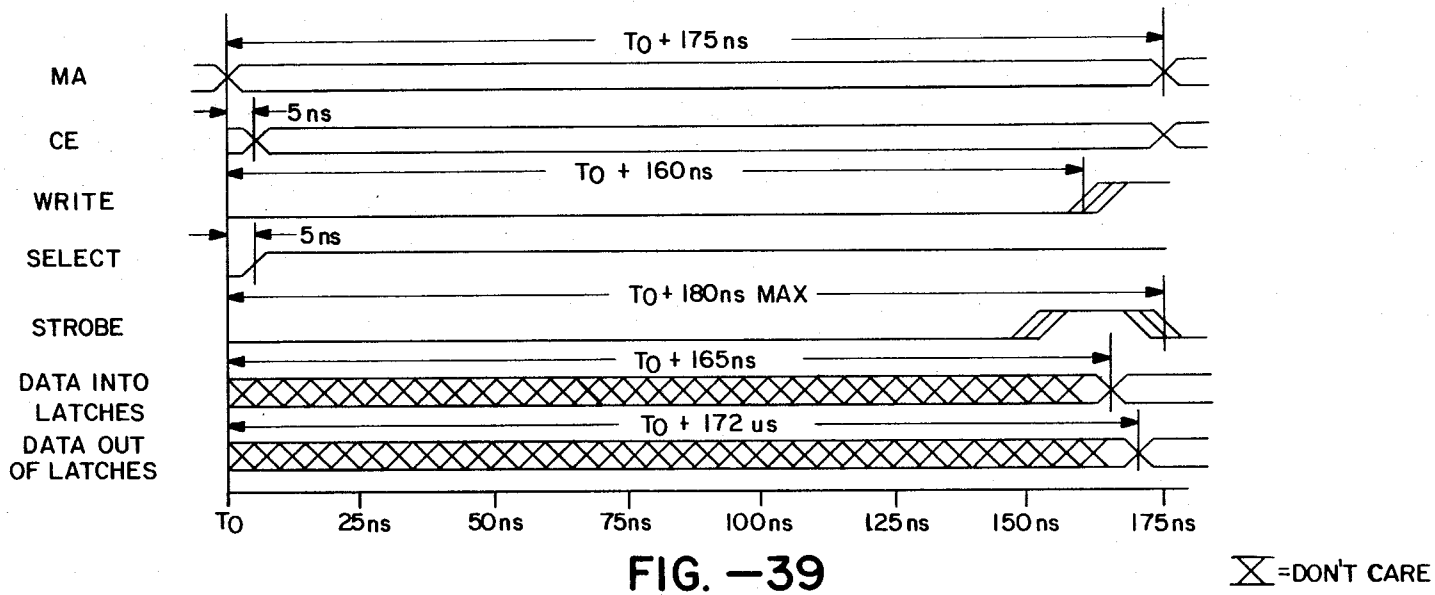
FIGS. 39–41 depict timing diagrams for the refresh memory of FIG. 38.
Figure 40:
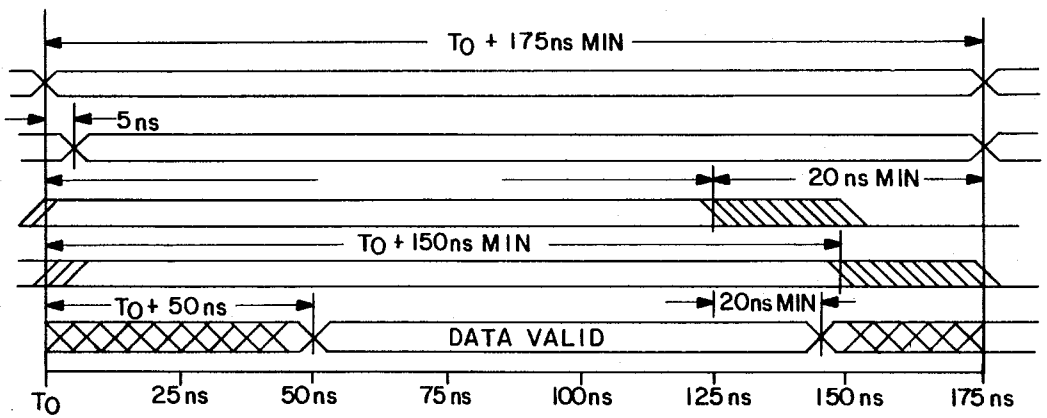
Figure 41:
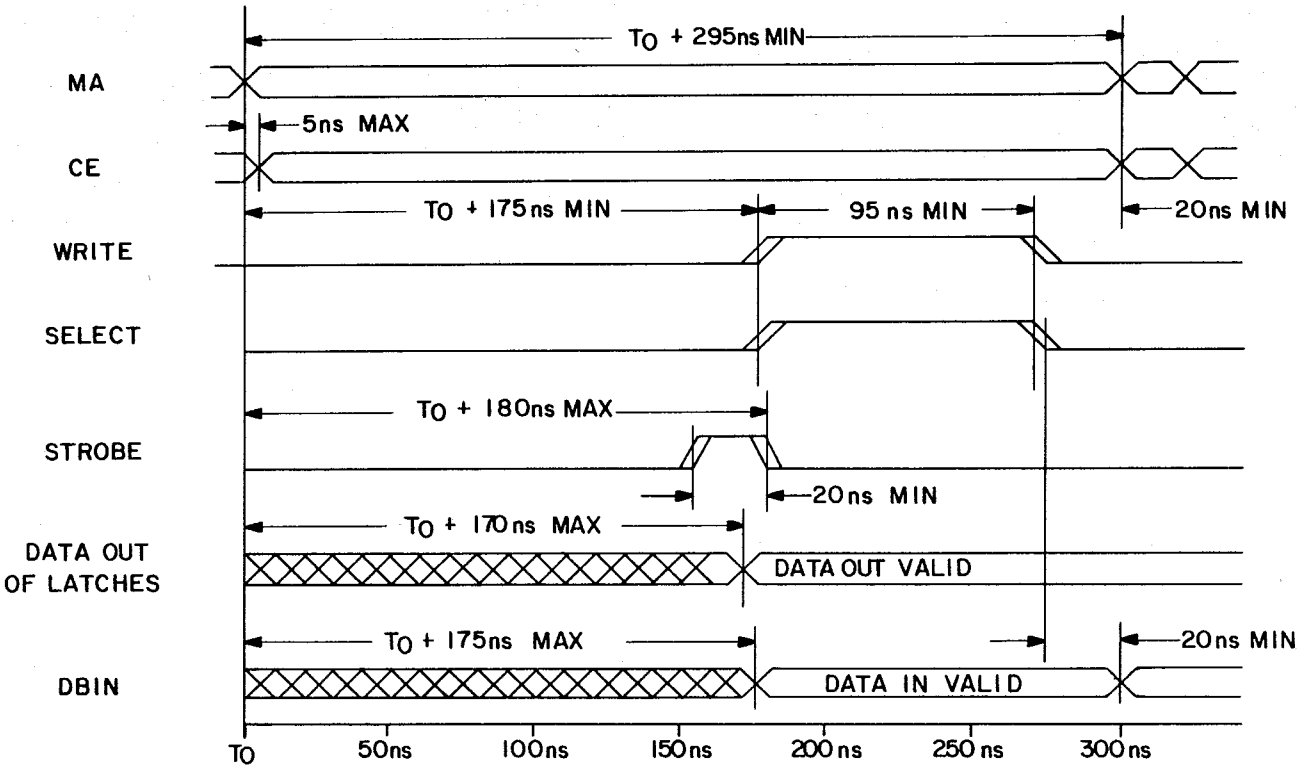

Timing diagrams depicted in FIGS. 39–41 illustrate timing for read, write, and read/write operations, respectively, assuming that the memory integrated circuits used are 2141-3 static RAMs. Typically, read/-write operations are not performed by system 15, because of the ones-latching feature of the normal write operation, but the timing for such an operation is nevertheless illustrated, as an indication of the value of the ones-latching feature.

What is claimed is:

1. In a graphics display system having vector memory means for storing vector data representing one or more graphics images to be displayed, a memory update circuit comprising means for inserting said vector data into said vector memory means wherein said vector data represents one or more polygons and the representation of each polygon includes header information specifying the format of said representation and the properties of said polygons, means for modifying said vector data within said vector memory means, means for retrieving said vector data from said vector memory means, and control means for associatively addressing specified ones of said polygons according to a specified set of said properties.

2. A circuit as in claim 1 wherein said control means includes means for sequentially accessing said vector data within said vector memory means.

3. A circuit as in claim 2 wherein said control means includes means for inserting additional vector data into sequential address locations within said vector memory means, beginning at the first encountered location having no data.

4. A circuit as in claim 1 or 2 wherein said control means includes means for inserting additional vector data into sequential address locations within said vector memory means at locations immediately following the last data word of said polygon representations and further including means for relocating existing vector data within said vector memory means to make room for said additional vector data.

5. A circuit as in claim 1 wherein said polygon representation represents the first point of said polygon in absolute coordinates and represents subsequent points in relative coordinates and wherein said system includes preclipper means for converting said relative coordinates into absolute coordinates.

6. A circuit as in claim 1 wherein said control means includes ring buffer means for modifying said vector data.

7. A circuit as in claim 6 wherein said ring buffer means includes a first ring buffer for storing unmodified data, a second ring buffer for storing modified polygon data and means for determining whether said polygon data should be returned to said vector memory means in modified or unmodified form.

8. In a graphics display system having first and second memory means, the method comprising the steps of storing vector data representing one or more graphics images to be displayed in said first memory means wherein said vector data representing one or more polygons and wherein the representation of each polygon includes header information specifying the format of said representation and the properties of said polygons, rasterizing said vector data into said second memory means thereby forming rasterized data, reading said rasterized data from said second memory means and displaying said rasterized data, inserting said vector data into said first memory means, modifying said vector data within said first memory means and retrieving said vector data from said first memory means, and associatively addressing specified ones of said polygons according to a specified set of said properties.

9. A method as in claim 8 including the steps of sequentially accessing said vector data within said vector memory means.

10. A method as in claim 9 including the steps of inserting additional vector data into sequential address locations within said vector memory means, beginning at the first-encountered location having no data.

11. A method as in claim 9 including the steps of inserting additional vector data into sequential address locations within said vector memory means at locations immediately following the last data word of one of said polygon representations and relocating existing vector data within said vector memory means to make room for said additional vector data.

12. A method as in claim 8 wherein said polygon representation represents the first point of said polygon in absolute coordinates and represents subsequent points in relative coordinates, and including the step of converting said relative coordinates into absolute coordinates.

13. A method as in claim 8 including the steps of storing unmodified data, storing modified polygon data and determining whether said polygon data should be returned to said first memory means in modified or unmodified form.

14. In a graphics display system having vector memory means for storing vector data representing one or more graphics images to be displayed wherein said vector data represents one or more polygons and the representation of each polygon includes header information specifying the format of said representation and the properties of said polygons, the method comprising the steps of inserting said vector data into said vector data memory means, modifying said vector data within said vector memory means, retrieving said vector data from said vector memory means, and associatively addressing specified ones of said polygons according to a specified set of said properties.

15. A method as in claim 14 including the step of sequentially accessing said vector data within said vector memory means.

16. A method as in claim 15 including the step of inserting additional vector data into sequential address locations within said vector memory means, beginning at the first encountered location having no data.

17. A method as in claim 14 or 15 including the steps of inserting additional vector data into sequential address locations within said vector memory means at locations immediately following the last data word of said polygon representations and relocating existing vector data within said vector memory means to make room for said additional vector data.

18. A method as in claim 14 wherein said polygon representation represents the first point of said polygon in absolute coordinates and represents subsequent points in relative coordinates and including the step of converting said relative coordinates into absolute coordinates.

19. A method as in claim 14 including the steps of storing unmodified data, storing modified polygon data and determining whether said polygon data should be returned to said vector memory means in modified or unmodified form.

* * * * *